US012319486B2

(12) United States Patent
Kamigaki et al.

(10) Patent No.: US 12,319,486 B2
(45) Date of Patent: Jun. 3, 2025

(54) CUSHIONING MATERIAL, PACKING MATERIAL, AND PACKAGE

(71) Applicant: SEIKO EPSON CORPORATION, Tokyo (JP)

(72) Inventors: Shinya Kamigaki, Shiojiri (JP); Sanshiro Takeshita, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 115 days.

(21) Appl. No.: 18/169,559

(22) Filed: Feb. 15, 2023

(65) Prior Publication Data

US 2023/0264882 A1 Aug. 24, 2023

(30) Foreign Application Priority Data

Feb. 18, 2022 (JP) ..... 2022-023394

(51) Int. Cl.
*B65D 81/05* (2006.01)

(52) U.S. Cl.
CPC ..... *B65D 81/057* (2013.01); *B65D 2581/053* (2013.01)

(58) Field of Classification Search
CPC .. B65D 81/057; B65D 81/107; B65D 81/127; B65D 65/44
USPC ..... 206/586, 591, 594, 585, 521, 453, 454, 206/449; 229/90, 87.02, 103.2; 248/687, 248/346.4, 36.91, 153, 221
See application file for complete search history.

(56) References Cited

U.S. PATENT DOCUMENTS 3,288,353 A * 11/1966 McCullough ..... B65D 81/03 229/87.02
5,048,689 A * 9/1991 McFarland ..... B65D 5/5033 206/453
2005/0109655 A1* 5/2005 Vershum ..... B65D 75/06 206/521

FOREIGN PATENT DOCUMENTS

JP 2010-274936 A 12/2010

* cited by examiner

*Primary Examiner* — Rafael A Ortiz
(74) *Attorney, Agent, or Firm* — WORKMAN NYDEGGER

(57) ABSTRACT

A cushioning material includes cushioning sheets stacked on top of another and configured to reduce an external force acting on an electrical device. The cushioning sheets include a first cushioning sheet that is positioned to intersect a direction of the external force acting on the electrical device and a second cushioning sheet that has a higher strength in the direction of the external force acting on the electrical device than the first cushioning sheet and is positioned to intersect the direction of the external force acting on the electrical device.

6 Claims, 17 Drawing Sheets

CUSHIONING MATERIAL, PACKING MATERIAL, AND PACKAGE

The present application is based on, and claims priority from JP Application Serial Number 2022-023394, filed Feb. 18, 2022, the disclosure of which is hereby incorporated by reference herein in its entirety.

BACKGROUND

1. Technical Field

The present disclosure relates to a cushioning material, a packing material, and a package.

2. Related Art

A known cushioning material reduces an external force acting on an electrical device. For example, JP-A-2010-274936 discloses a technology relating to a cushioning material that includes stacked cushioning sheets.

The cushioning material of the known technology includes multiple cushioning sheets having the same thickness and the same strength. To improve the cushioning ability of the cushioning material, many cushioning sheets need to be stacked on top of another.

SUMMARY

According to an aspect of the present disclosure, a cushioning material includes cushioning sheets stacked on top of another and configured to reduce an external force acting on an electrical device. The cushioning sheets include a first cushioning sheet that is positioned to intersect a direction of the external force acting on the electrical device and a second cushioning sheet that has a higher strength in the direction of the external force acting on the electrical device than the first cushioning sheet and is positioned to intersect the direction of the external force acting on the electrical device.

According to another aspect of the present disclosure, a cushioning material includes cushioning structures stacked on top of another and configured to reduce an external force acting on an electrical device. The cushioning structures include a first cushioning structure that is positioned to intersect a direction of the external force acting on the electrical device and a second cushioning structure that has a higher strength in the direction of the external force acting on the electrical device than the first cushioning structure and is positioned to intersect the direction of the external force acting on the electrical device.

According to another aspect of the present disclosure, a packing material includes a packing box that holds an electrical device and a cushioning material that includes cushioning sheets stacked on top of another and configured to reduce an external force acting on the electrical device. The cushioning sheets include a first cushioning sheet that is positioned to intersect a direction of the external force acting on the electrical device and a second cushioning sheet that has a higher strength in the direction of the external force acting on the electrical device than the first cushioning sheet and is positioned to intersect the direction of the external force acting on the electrical device.

According to another aspect of the present disclosure, a package includes an electrical device, a packing box holding the electrical device, and a cushioning material including cushioning sheets stacked on top of another and configured to reduce the external force acting on the electrical device. The cushioning sheets include a first cushioning sheet that is positioned to intersect a direction of the external force acting on the electrical device and a second cushioning sheet that has a higher strength in the direction of the external force acting on the electrical device than the first cushioning sheet and is positioned to intersect the direction of the external force acting on the electrical device.

DESCRIPTION OF EXEMPLARY EMBODIMENTS

Figure 1:
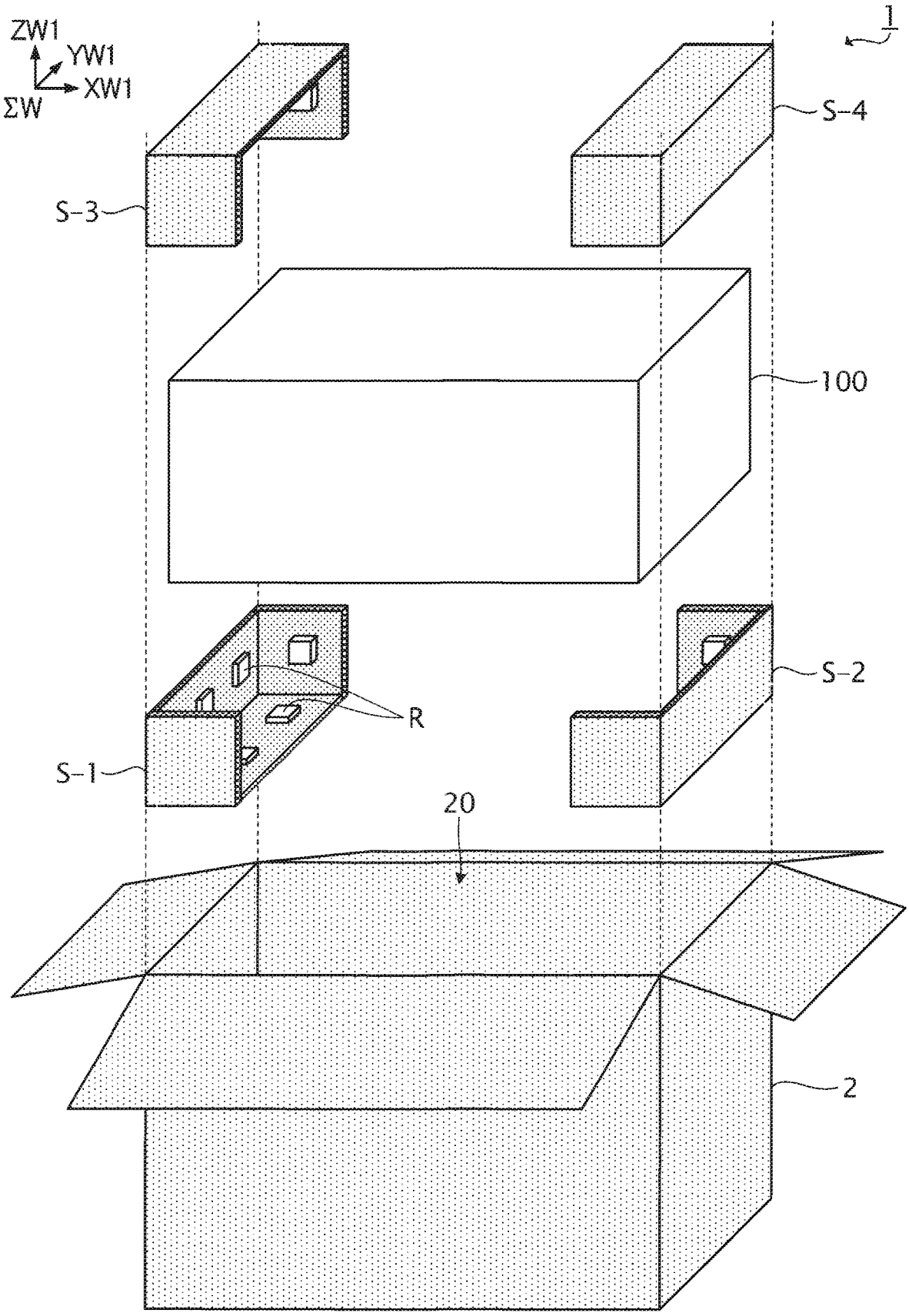
FIG. 1 is an exploded perspective view illustrating an example of a configuration of a packing material according to an embodiment of the present disclosure.

Hereinafter, an embodiment of the present disclosure will be described with reference to the drawings. In the drawings, the components are illustrated in different dimensions and different scale ratios from the actual dimensions and scale ratios as appropriate. Although various technically preferable limitations are made in the embodiment described below to illustrate specific examples of the present disclosure, the scope of the disclosure should not be limited to them unless such limitations are explicitly mentioned to limit the disclosure in the following description.

A. Embodiment

Hereinafter, a packing material 1 that holds an electrical device 100 will be described.

1. Outline of Packing Material

FIG. 1 is an exploded perspective view illustrating an example of a configuration of the packing material 1.

As illustrated in FIG. 1, the packing material 1 holds the electrical device 100. Specifically, the packing material 1 includes a packing box 2 that can hold the electrical device 100 and multiple supports S that support the electrical device 100 held in the packing box 2. The support S includes a cushioning material R that reduces an external force acting on the electrical device 100 held in the packing box 2. Here, the electrical device 100 is a printer, such as an ink jet printer, for example. In this embodiment, the electrical device 100 may be a device other than the printer, such as a television, a refrigerator, a microwave oven, or a personal computer, for example. In the following description, the combination of the packing material 1 and the electrical device 100 held in the packing material 1 is referred to as a "package" in some cases.

As illustrated in FIG. 1, in this embodiment, the packing material 1 includes four supports S-1 to S-4. In this embodiment, the electrical device 100 and the four supports S-1 to S-4 are put in the packing box 2 through an opening 20 of the packing box 2 to be held in the packing box 2.

The following description uses, for convenience of explanation, a packing box coordinate system ΣW fixed to the packing box 2. The packing box coordinate system ΣW is a three-axis coordinate system including a ZW axis extending in a ZW1 direction from the bottom surface of the packing box 2 toward the opening 20, an XW axis extending in an XW1 direction perpendicular to the ZW1 direction, and a YW axis extending in a YW1 direction perpendicular to both the ZW1 direction and the XW1 direction. In this embodiment, the XW axis, the YW axis, and the ZW axis are perpendicular to each other, but the present disclosure should not be limited to this. The XW axis, the YW axis, and the ZW axis only need to intersect each other. In the following description, a direction opposite the XW1 direction is referred to as an XW2 direction, a direction opposite the YW1 direction is referred to as a YW2 direction, and a direction opposite the ZW1 direction is referred to as a ZW2 direction.

As illustrated in FIG. 1, when the electrical device 100 and the four supports S-1 to S-4 are held in the packing box 2, the support S-1 is one of the supports S that supports the electrical device 100 at the lower end portion in the ZW2 direction and the XW2 direction. When the electrical device 100 and the four supports S-1 to S-4 are held in the packing box 2, the support S-2 is one of the supports S that supports the electrical device 100 at the lower end portion in the ZW2 direction and the XW1 direction. When the electrical device 100 and the four supports S-1 to S-4 are held in the packing box 2, the support S-3 is one of the supports S that supports the electrical device 100 at the upper end portion in the ZW1 direction and the XW2 direction. When the electrical device 100 and the four supports S-1 to S-4 are held in the packing box 2, the support S-4 is one of the supports S that supports the electrical device 100 at the upper end portion in the ZW1 direction and the XW1 direction.

2. Outline of Support and Cushioning Material

Hereinafter, with reference to FIGS. 2 to 4, examples of the support S and the cushioning material R of this embodiment will be described.

Figure 2:
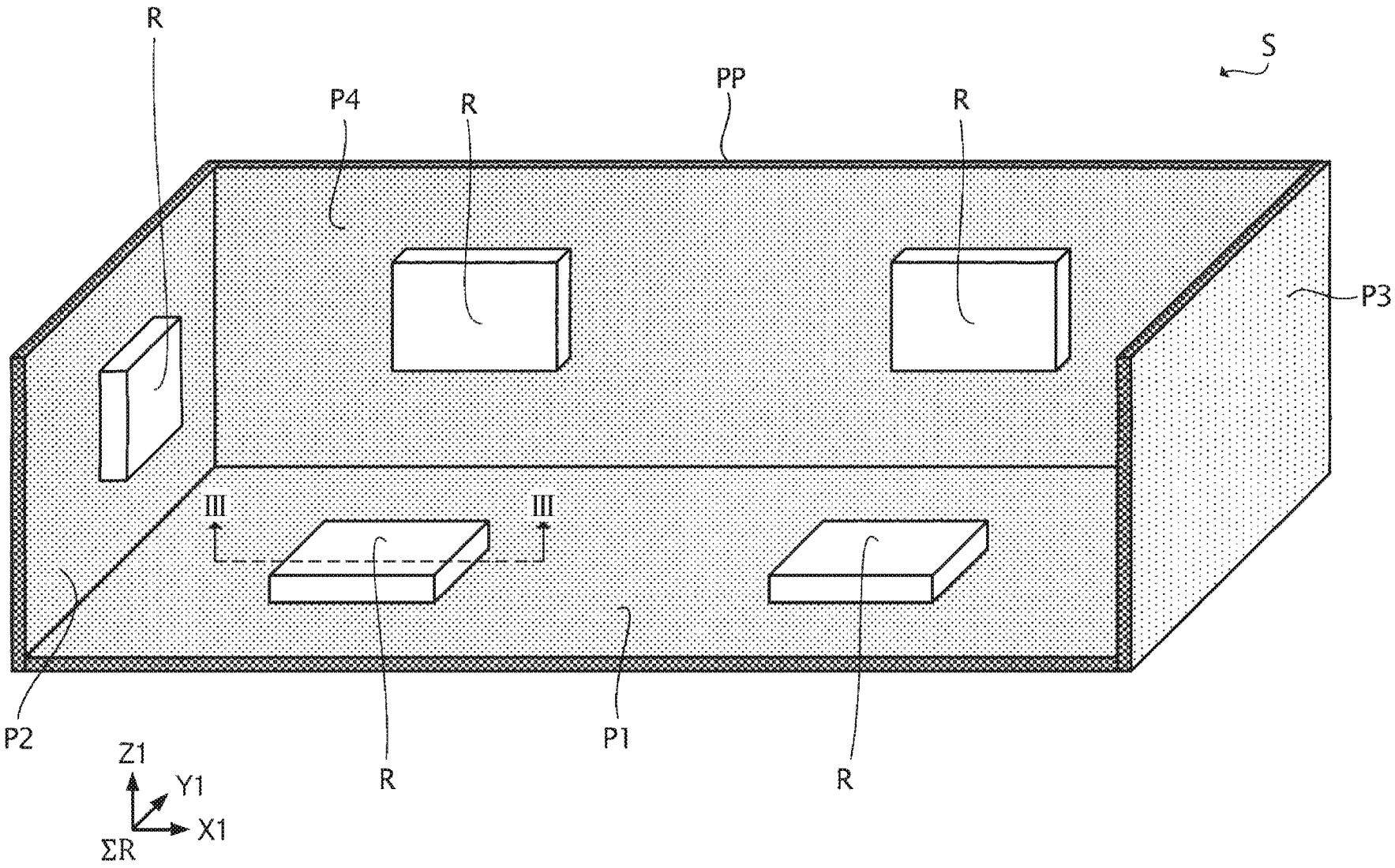
FIG. 2 is a perspective view illustrating an example of a structure of a support.

FIG. 2 is a perspective view illustrating an example of a configuration of the support S.

As illustrated in FIG. 2, the support S includes multiple cushioning materials R that reduce an external force acting on the electrical device 100 and a retainer PP that retains the cushioning materials R.

The retainer PP includes a plate-like portion P1 that constitutes a bottom of the support S, a plate-like portion P2 that constitutes one of two lateral sides of the support S, a plate-like portion P3 that constitutes the other of the two lateral sides of the support S, and a plate-like portion P4 that constitutes a rear side of the support S. In the following description, the plate-like portion P1, the plate-like portion P2, the plate-like portion P3, and the plate-like portion P4 are collectively referred to as the plate-like portions P in some cases. In an example of this embodiment, the plate-like portions P, which constitute the retainer PP, are each formed of corrugated cardboard.

As illustrated in FIG. 2, in this embodiment, the support S includes two cushioning materials R retained by the plate-like portion P1, one cushioning material R retained by the plate-like portion P2, one cushioning material R retained by the plate-like portion P3, and two cushioning materials R retained by the plate-like portion P4. In this embodiment, the cushioning materials R, which are included in the support S, are each formed of corrugated cardboard.

The following description uses, for convenience of explanation, a cushioning material coordinate system ER fixed to each of the cushioning materials R. The cushioning material coordinate system ER is a three-axis coordinate system including a Z axis extending in a Z1 direction, an X axis extending in an X1 direction, and a Y axis extending in a Y1 direction. Here, the Z1 direction is a direction in which one of surfaces of the cushioning material R that is in contact with the plate-like portion P of the support S faces the surface opposite the one of the surfaces and is perpendicular to the extending direction of the plate-like portion P. The X1 direction is a direction perpendicular to the Z1 direction and is parallel to the extending direction of the plate-like portion P. The Y1 direction is a direction perpendicular to the Z1 direction and the X1 direction and is parallel to the extending direction of the plate-like portion P. In this embodiment, the X axis, the Y axis, and the Z axis are perpendicular to each other, but the present disclosure should not be limited to this. The X axis, the Y axis, and the Z axis only need to intersect each other. In the following description, a direction opposite the X1 direction is referred to as an X2 direction, a direction opposite the Y1 direction is referred to as a Y2 direction, and a direction opposite the Z1 direction is referred to as a Z2 direction.

In other words, in this embodiment, the cushioning material coordinate system ER is defined such that, when the electrical device 100 and the four supports S-1 to S-4 are held in the packing box 2, a direction from the cushioning material R to the electrical device 100 corresponds to the Z1 direction.

Figure 3:
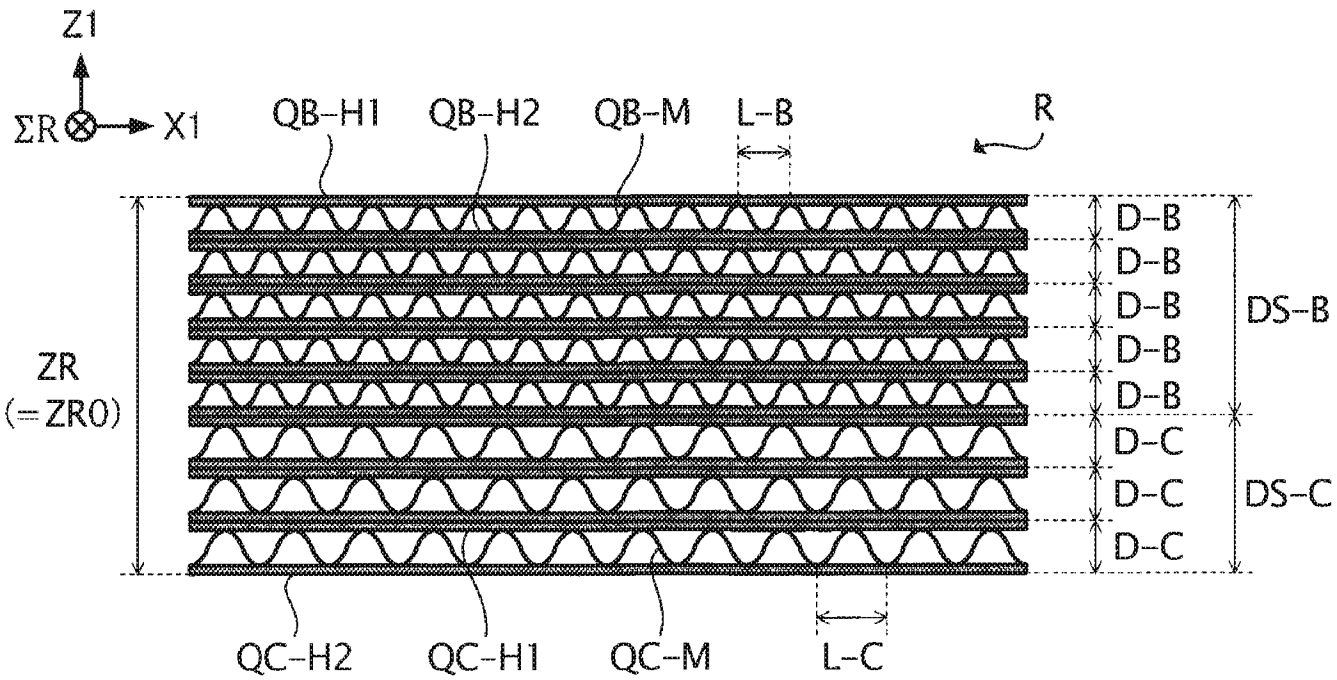
FIG. 3 is a cross-sectional view illustrating an example of a structure of a cushioning material.

FIG. 3 is a cross-sectional view of the cushioning material R taken along line III-III in FIG. 2 and illustrates an example of a cross-sectional configuration of the cushioning material R.

As illustrated in FIG. 3, the cushioning material R includes a cushioning block DS-B including multiple cushioning sheets D-B and a cushioning block DS-C including multiple cushioning sheets D-C. Specifically, in this embodiment, the number of cushioning sheets D-B included in the cushioning block DS-B is larger than the number of cushioning sheets D-C included in the cushioning block DS-C. More specifically, in an example of this embodiment, the cushioning block DS-B includes five cushioning sheets D-B, and the cushioning block DS-C includes three cushioning sheets D-C.

In the following description, the cushioning sheets D-B and the cushioning sheets D-C are collectively referred to as the cushioning sheets D in some cases. In other words, in this embodiment, the cushioning material R includes the stacked cushioning sheets D. As illustrated in FIG. 3, the cushioning sheets D, which constitute the cushioning material R, are each positioned to extend in a direction intersecting the Z axis direction. Specifically, the cushioning sheets D, which constitute the cushioning material R, are each positioned to extend in the X axis direction and the Y axis direction. In this embodiment the cushioning sheets D, which constitute the cushioning material R, are each formed of corrugated cardboard.

Furthermore, in an example of this embodiment, the cushioning block DS-C is adjacent to the cushioning block DS-B in the Z2 direction. In this embodiment, when the electrical device 100 and the four supports S-1 to S-4 are held in the packing box 2, the cushioning material R is positioned such that the cushioning block DS-B is located between the cushioning block DS-C and the electrical device 100. In other words, in this embodiment, when the electrical device 100 and the four supports S-1 to S-4 are held in the packing box 2, the cushioning material R is positioned such that the cushioning sheets D-B are located between the cushioning sheets D-C and the electrical device 100.

The cushioning sheet D-B includes a liner QB-H1, a liner QB-H2, and a core member QB-M. The liner QB-H1 and the liner QB-H2 are plate-like members formed of paper. The core member QB-M is a corrugated member formed of paper and is located between the liner QB-H1 and the liner QB-H2. Specifically, the core member QB-M has a corrugated shape having curves that are repeated at an interval L-B and is fixed to the liner QB-H1 and the liner QB-H2 with an adhesive, for example. The cushioning sheet D-C includes a liner QC-H1, a liner QC-H2, and a core member QC-M. The liner QC-H1 and the liner QC-H2 are plate-like members formed of paper. The core member QC-M is a corrugated member formed of paper and is located between the liner QC-H1 and the liner QC-H2. Specifically, the core member QC-M has a corrugated shape having curves that are repeated at an interval L-C and is fixed to the liner QC-H1 and the liner QC-H2 with an adhesive, for example. In this embodiment, the interval L-C, which corresponds to the cycle of the waveform of the core member QC-M, is longer than the interval L-B, which corresponds to the cycle of the waveform of the core member QB-M.

In the following description, a thickness ZD-B is the thickness in the Z axis direction of the cushioning sheet D-B, and a thickness ZD-C is the thickness in the Z axis direction of the cushioning sheet D-C. In the following description, the thickness ZD-B and the thickness ZD-C are collectively referred to as the thickness ZD in some cases. In the following description, a reference thickness ZD-B0 is the thickness ZD-B of the cushioning sheet D-B not compressed in the Z axis direction with no force in the Z axis direction acting on the cushioning sheet D-B, and a reference thickness ZD-CO is the thickness ZD-C of the cushioning sheet D-C not compressed in the Z axis direction with no force in the Z axis direction acting on the cushioning sheet D-C.

In this embodiment, as illustrated in FIG. 3, the reference thickness ZD-CO is larger than the reference thickness ZD-B0. In this embodiment, the density of the core member QB-M of the cushioning sheet D-B is higher that the density of the core member QC-M of the cushioning sheet D-C. Thus, in this embodiment, the cushioning sheet D-B has a higher strength in the Z axis direction than the cushioning sheet D-C.

In the following description, a thickness ZR is the thickness in the Z axis direction of the cushioning material R. Furthermore, in the following description, a reference thickness ZR0 is the thickness ZR in the Z axis direction of the cushioning material R not compressed in the Z axis direction with no force in the Z axis direction acting on the cushioning material R. In the following description, a compression coefficient VZ is a value obtained by dividing a compressed thickness, which is obtained by subtracting the thickness ZR from the reference thickness ZR0, by the reference thickness ZR0. In other words, the compression coefficient VZ is a positive real number that satisfies "VZ=(ZR0−ZR)÷ZR0". In this embodiment, the compression coefficient VZ satisfies "0 ≤VZ≤1".

Figure 4:
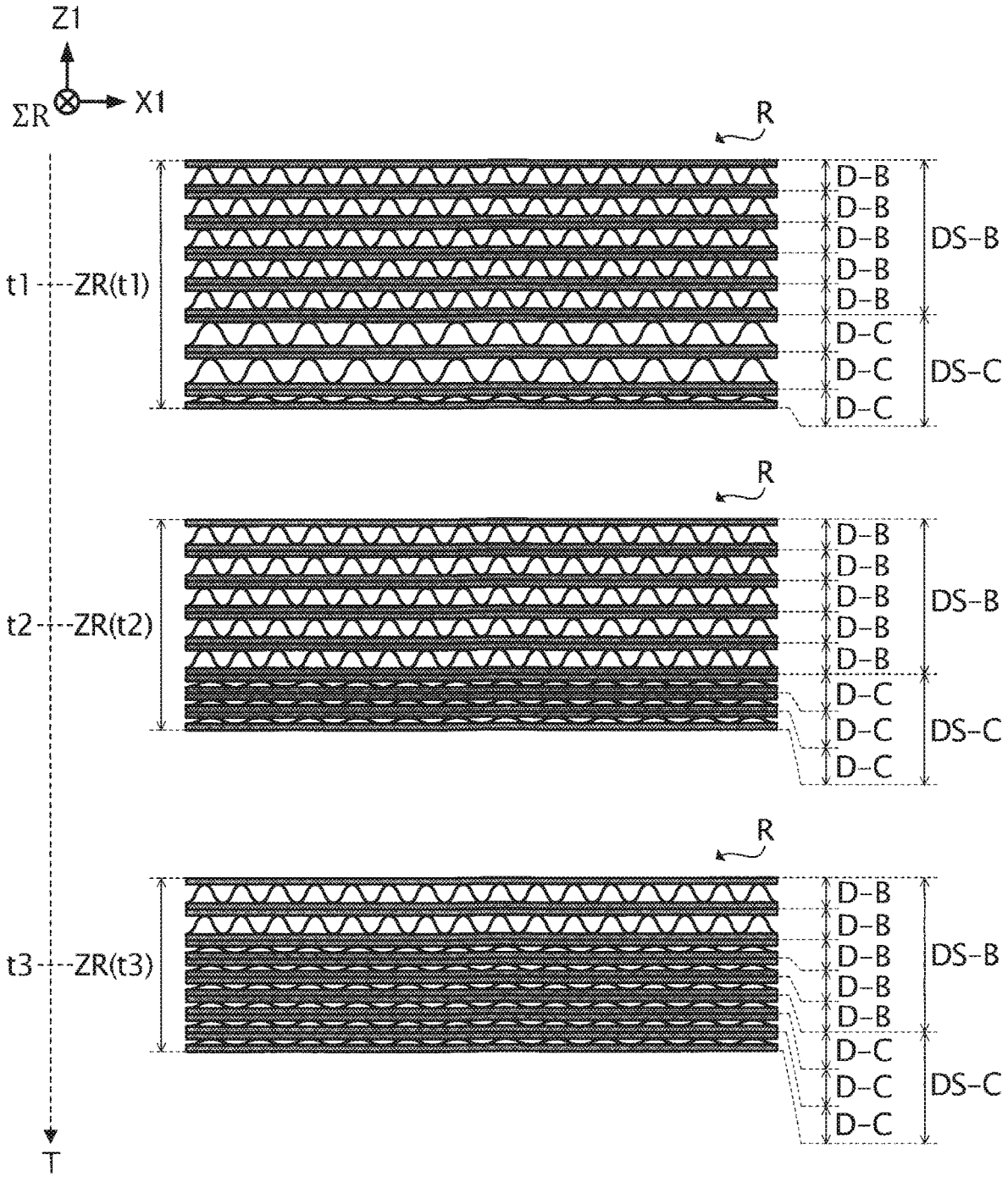
FIG. 4 is a cross-sectional view illustrating an example of how the cushioning material deforms.

FIG. 4 is a view for explaining an example of how the cushioning material R is compressed in the Z axis direction by a force in the Z axis direction.

In FIG. 4, a thickness ZR (t1) is the thickness ZR of the cushioning material R at the time t1, which is after the time t0 the force in the Z axis direction starts acting on the cushioning material R and at which a force in the Z axis direction is acting on the cushioning material R, a thickness ZR (t2) is the thickness ZR of the cushioning material Z at the time t2, which is after the time t1 and at which a force in the Z axis direction is acting on the cushioning material R, and a thickness ZR (t3) is the thickness ZR of the cushioning material R at the time t3, which is after the time t2 and at which a force in the Z axis direction is acting on the cushioning material R.

As illustrated in FIG. 4, when a force in the Z axis direction starts acting on the cushioning material R, one of the cushioning sheets D-C included in the cushioning block DS-C is gradually compressed in the Z axis direction from the time t0 to the time t1, and at the time t1, the one of the cushioning sheets D-C is compressed and crushed flat in the Z axis direction. Then, from the time t1 to the time t2, the other cushioning sheets D-C included in the cushioning block DS-C are compressed in the Z axis direction one after another, and at the time t2, all the cushioning sheets D-C included in the cushioning block DS-C are compressed and crushed flat in the Z axis direction. Then, from the time t2 to the time t3, some of the cushioning sheets D-B included in the cushioning block DS-B are compressed in the Z axis direction, and at the time t3, the some of the cushioning sheets D-B included in the cushioning block DS-B are compressed and crushed flat in the Z axis direction. In an example illustrated in FIG. 4, at the time t3, the force in the Z axis direction stops acting on the cushioning material R.

As described above, when the force in the Z axis direction is applied to the cushioning material R, the cushioning sheet D-C having a low strength is compressed and crushed flat before the cushioning sheet D-B having a high strength.

3. Comparison with Cushioning Material of Comparative Example

Next, with reference to FIGS. 5 to 11, a cushioning material of Comparative Example will be described to clarify the advantages of the cushioning material R of the present embodiment.

Figure 5:
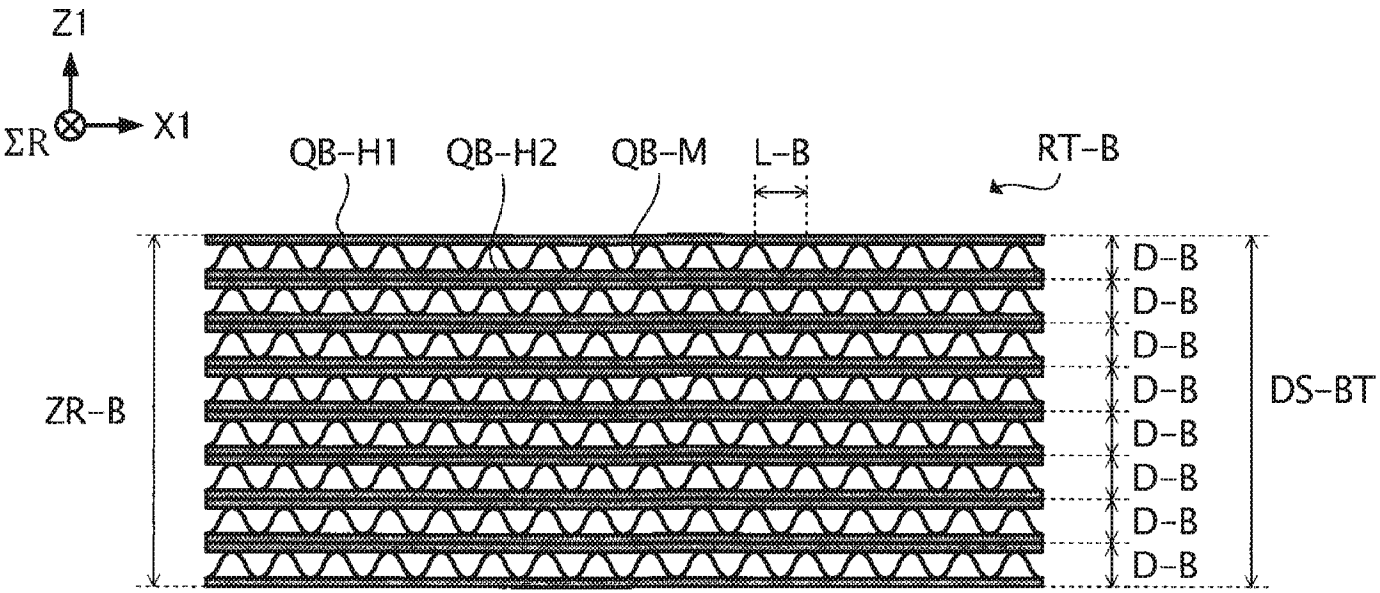
FIG. 5 is a cross-sectional view illustrating an example of a structure of a cushioning material of Comparative Example 1.

FIG. 5 is a cross-sectional view illustrating a cross-sectional configuration of a cushioning material RT-B according to Comparative Example 1.

As illustrated in FIG. 5, the cushioning material RT-B does not include the cushioning sheets D-C but includes a cushioning block DS-BT that includes stacked cushioning sheets D-B. Specifically, in Comparative Example 1, the cushioning block DS-BT includes eight cushioning sheets D-B, for example.

In the following description, a thickness ZR-B is the thickness in the Z axis direction of the cushioning material RT-B. In the following description, a reference thickness ZR-BC is the thickness ZR-B in the Z axis direction of the cushioning material R not compressed in the Z axis direction with no force in the Z axis direction acting on the cushioning material RT-B. In the following description, a compression coefficient VZ-B is a value obtained by dividing the compressed thickness, which is obtained by subtracting the thickness ZR-B from the reference thickness ZR-B0, by the reference thickness ZR-B0.

Figure 6:
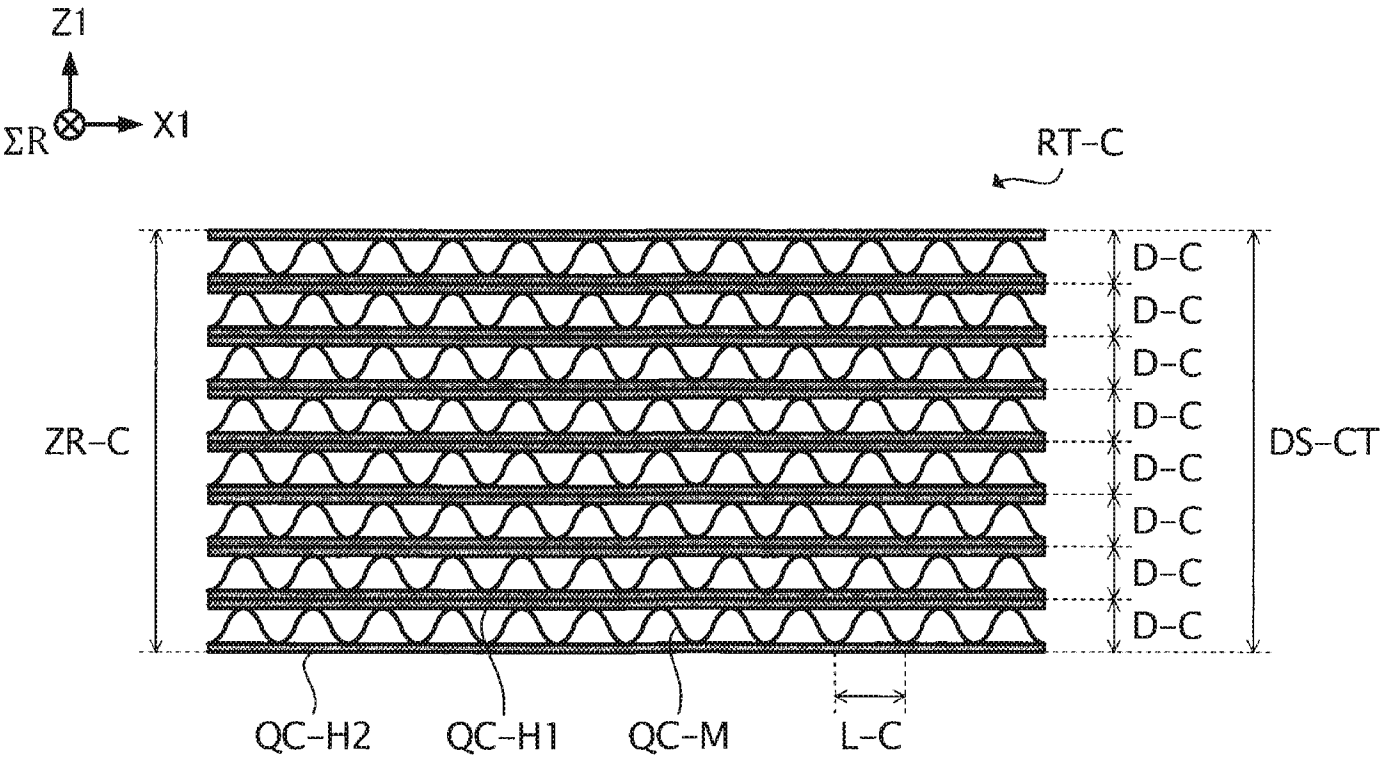
FIG. 6 is a cross-sectional view illustrating an example of a structure of a cushioning material of Comparative Example 2.

FIG. 6 is a cross-sectional view illustrating a cross-sectional configuration of a cushioning material RT-C according to Comparative Example 2.

As illustrated in FIG. 6, the cushioning material RT-C does not include the cushioning sheets D-B but includes a cushioning block DS-CT that includes stacked cushioning sheets D-C. Specifically, in Comparative Example 2, the cushioning block DS-CT includes eight cushioning sheets D-C, for example.

In the following description, a thickness ZR-C is the thickness in the Z axis direction of the cushioning material RT-C. Furthermore, in the following description, a reference thickness ZR-CO is the thickness ZR-C in the Z axis direction of the cushioning material RT-C not compressed in the Z axis direction with no force in the Z axis direction acting on the cushioning material RT-C. In the following description, a compression coefficient VZ-C is a value obtained by dividing the compressed thickness, which is obtained by subtracting the thickness ZR-C from the reference thickness ZR-CO, by the reference thickness ZR-CO.

Figure 7:
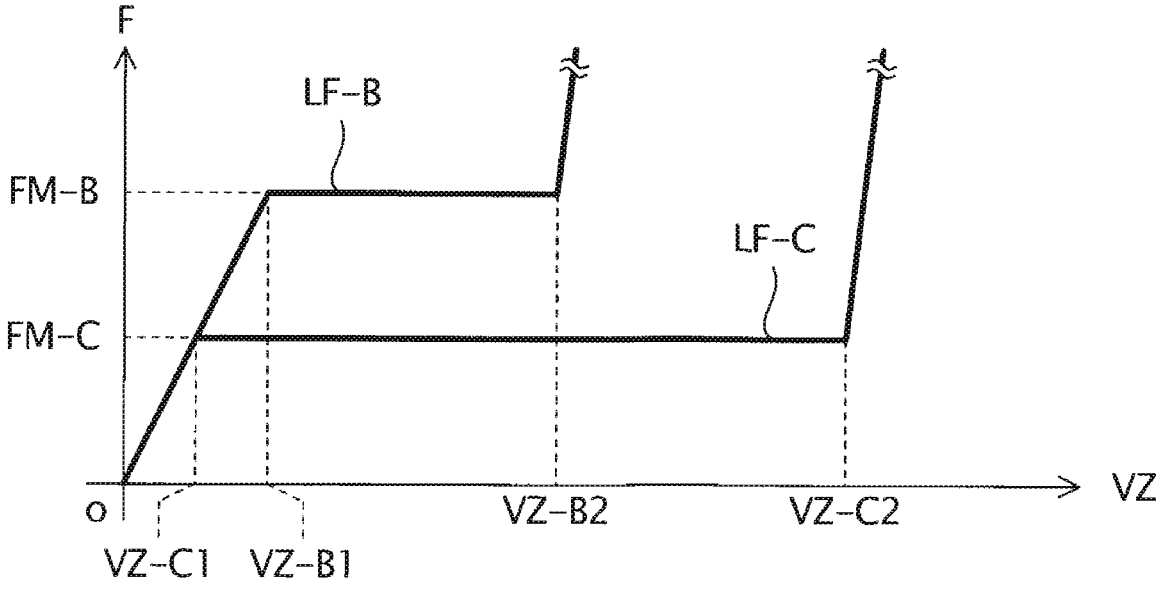
FIG. 7 is a diagram for explaining an example of a compressive force.

FIG. 7 is a diagram for explaining an example of a compressive force F.

Here, the compressive force F is a force acting on the cushioning material R in the Z axis direction to compress the cushioning material R. In FIG. 7, a related line LF-B indicates the relationship between the compression coefficient VZ-B of the cushioning material RT-B and the compressive force F acting on the cushioning material RT-B. Furthermore, in FIG. 7, a related line LF-C indicates the relationship between the compression coefficient VZ-C of the cushioning material RT-C and the compressive force F acting on the cushioning material RT-C.

As indicated in FIG. 7, when the compressive force F is applied to the cushioning material RT-B, the compression coefficient VZ-B of the cushioning material RT-B gradually increases from "0". The compressive force F applied to the cushioning material RT-B is kept at a constant compressive force FM-B from the time the compression coefficient VZ-B reaches the value VZ-B1, which is larger than "0", until the compression coefficient VZ-B reaches the value VZ-B2, which is larger than the value VZ-B1. In other words, when the compression coefficient VZ-B satisfies "VZ-B1≤VZ-B≤VZ-B2", the cushioning material RT-B reduces an external force acting on the cushioning material RT-B and transmits the compressive force FM-B to the electrical device 100. After the compression coefficient VZ-B exceeds the "value VZ-B2", the compressive force F acting on the cushioning material RT-B increases as the compression coefficient VZ-B increases. Here, when the compression coefficient VZ-B is the value VZ-B2, all the cushioning sheets D-B of the cushioning material RT-B are being compressed and crushed flat.

As indicated in FIG. 7, when the compressive force F is applied to the cushioning material RT-C, the compression coefficient VZ-C of the cushioning material RT-C gradually increases from "0". The compressive force F acting on the cushioning material RT-C is kept at a constant compressive force FM-C, which is smaller than the compressive force FM-B, from the time the compression coefficient VZ-C reaches the value VZ-C1, which is larger than "0", until the compression coefficient VZ-C reaches the value VZ-C2, which is larger than the value VZ-C1. In other words, when the compression coefficient VZ-C satisfies "VZ-C1≤VZ-C≤VZ-C2", the cushioning material RT-C reduces an external force acting on the cushioning material RT-C and transmits the compressive force FM-C to the electrical device 100. After the compression coefficient VZ-C exceeds the "value VZ-C2", the compressive force F acting on the cushioning material RT-C increases as the compression coefficient VZ-C increases. Here, when the compression coefficient VZ-C is the value VZ-C2, all the cushioning sheets D-C of the cushioning material RT-C are being compressed and crushed flat.

Figure 8:
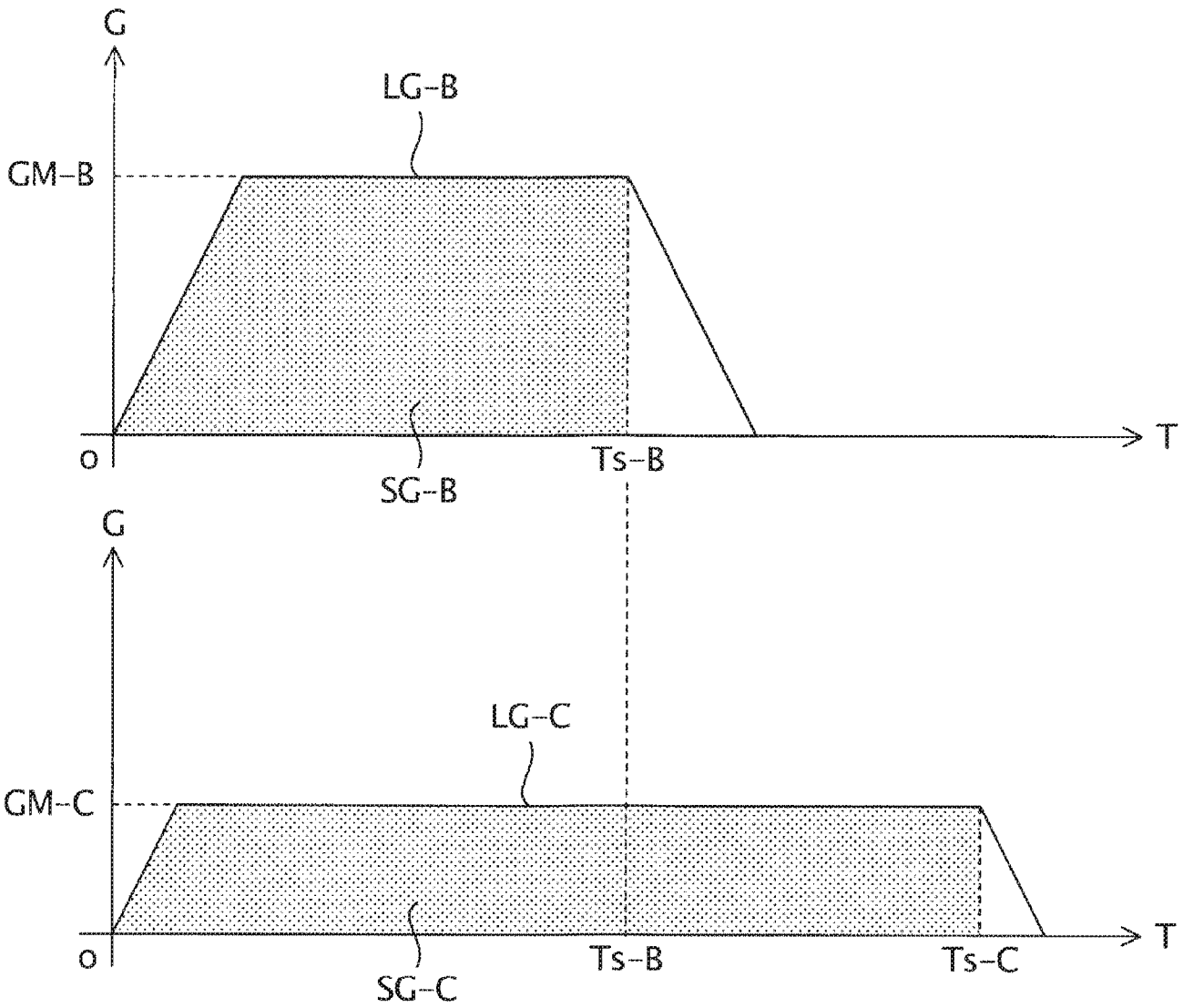
FIG. 8 is a diagram for explaining an example of the acceleration of the electrical device.

FIG. 8 is a diagram indicating an example of the acceleration G of the electrical device 100.

Specifically, FIG. 8 indicates the acceleration G of the electrical device 100 in a case in which the packing material 1 holding the electrical device 100 having a predetermined weight is dropped on a floor from a predetermined height. More specifically, in FIG. 8, an acceleration line LG-B indicates a change over time in the acceleration G of the electrical device 100, which is held in the packing material 1, during its fall from a predetermined height with the cushioning material RT-B being present between the electrical device 100 and the floor. Furthermore, in FIG. 8, an acceleration line LG-C indicates a change over time in the acceleration G of the electrical device 100, which is held in the packing material 1, during its fall from a predetermined height with the cushioning material RT-C being present between the electrical device 100 and the floor. The acceleration lines LG-B and LG-C do not indicate actual measured values of the acceleration G of the electrical device 100 but indicates logical values of the acceleration G of the electrical device 100.

As indicated in FIG. 8, when the electrical device 100 is dropped from a predetermined height with the cushioning material RT-B being present between the electrical device 100 and the floor, the electrical device 100 receives the compressive force FM-B from the cushioning material RT-B, and thus the electrical device 100 has acceleration GM-B corresponding to the compressive force FM-B. In FIG. 8, the electrical device 100 dropped from a predetermined height with the cushioning material RT-B being present between the electrical device 100 and the floor is supposed to stop before all the cushioning sheets D-B of the cushioning material RT-B are compressed and crushed flat. Specifically, in FIG. 8, when the electrical device 100 is dropped from a predetermined height with the cushioning material RT-B being present between the electrical device 100 and the floor, the cushioning material RT-B is supposed to absorb the drop impact of the electrical device 100 at the time Ts-B before all the cushioning sheets D-B of the cushioning material RT-B are compressed and crushed flat.

As indicated in FIG. 8, when the electrical device 100 is dropped from a predetermined height with the cushioning material RT-C being present between the electrical device 100 and the floor, the electrical device 100 receives the compressive force FM-C from the cushioning material RT-C, and thus the electrical device 100 has acceleration GM-C corresponding to the compressive force FM-C. In FIG. 8, the electrical device 100 dropped from a predetermined height with the cushioning material RT-C being present between the electrical device 100 and the floor is supposed to stop before all the cushioning sheets D-C of the cushioning material RT-C are compressed and crushed flat. Specifically, in FIG. 8, when the electrical device 100 is dropped from a predetermined height with the cushioning material RT-C being present between the electrical device 100 and the floor, the cushioning material RT-C is supposed to absorb the drop impact of the electrical device 100 at the time Ts-C before all the cushioning sheets D-C of the cushioning material RT-C are compressed and crushed flat.

Here, an area SG-B defined by the acceleration line LG-B and the line indicating the acceleration G=0 in the period from the time T=0, at which the packing material 1 holding the electrical device 100 comes in contact with the floor, to the time Ts-B, is equal to an area SG-C defined by the acceleration line LG-C and the line indicating the acceleration G=0 in the period from the time T=0 to the time Ts-C. As described above, the compressive force FM-B is larger than the compressive force FM-C. Thus, the acceleration GM-B is larger than the acceleration GM-C. In FIG. 8, the time Ts-C is after the time Ts-B.

As described above, the acceleration lines LG-B and LG-C indicate the logical values of the acceleration G of the electrical device 100. The actual measured values of the acceleration G of the electrical device 100 draw a curved line when the electrical device 100 held in the packing material 1 is dropped on a floor from a predetermined height.

Figure 9:
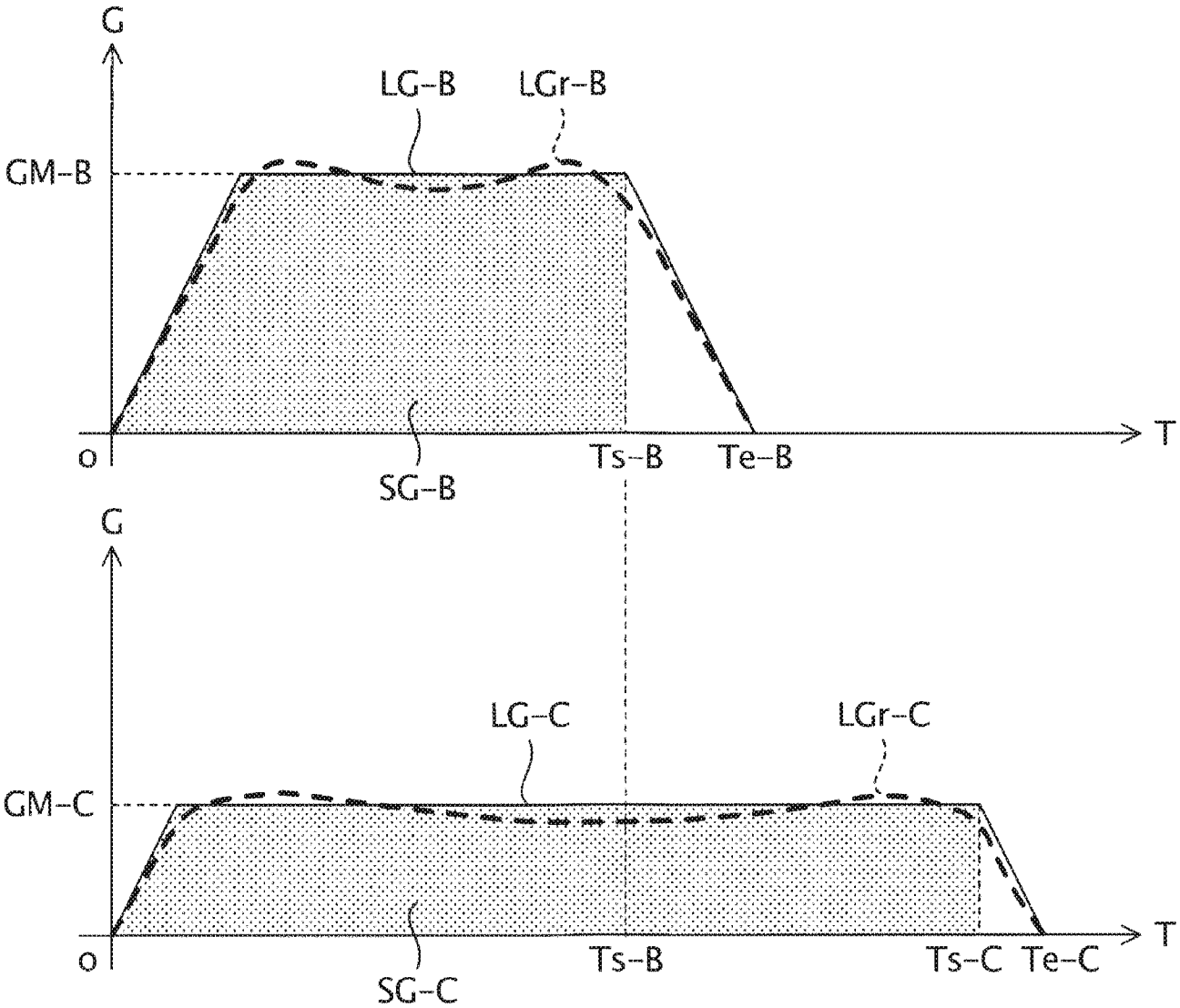
FIG. 9 is a diagram for explaining an example of actual measured values of the acceleration of the electrical device.

FIG. 9 indicates actual measured values of acceleration G of the electrical device 100 in a case in which the packing material 1 holding the electrical device 100 was dropped on a floor from a predetermined height. An acceleration line LGr-B is a curved line indicating actual measured values of the acceleration G of the electrical device 100 that was dropped from a predetermined height with the cushioning material RT-B being present between the electrical device 100 and the floor. An acceleration line LGr-C is a curved line indicating actual measured values of the acceleration G of the electrical device 100 that was dropped from a predetermined height with the cushioning material RT-C being present between the electrical device 100 and the floor.

As indicated in FIG. 9, the acceleration lines LGr-B and LGr-C each form a waveform having two peaks and are trapezoidal waves. The acceleration line LGr-B is a curved line in which the acceleration G starts increasing from "0" at the time T=0 and returns to "0" at the time Te-B. The acceleration line LGr-C is a curved line in which the acceleration G starts increasing from "0" at the time T=0 and returns to "0" at the time Te-C.

Figure 10:
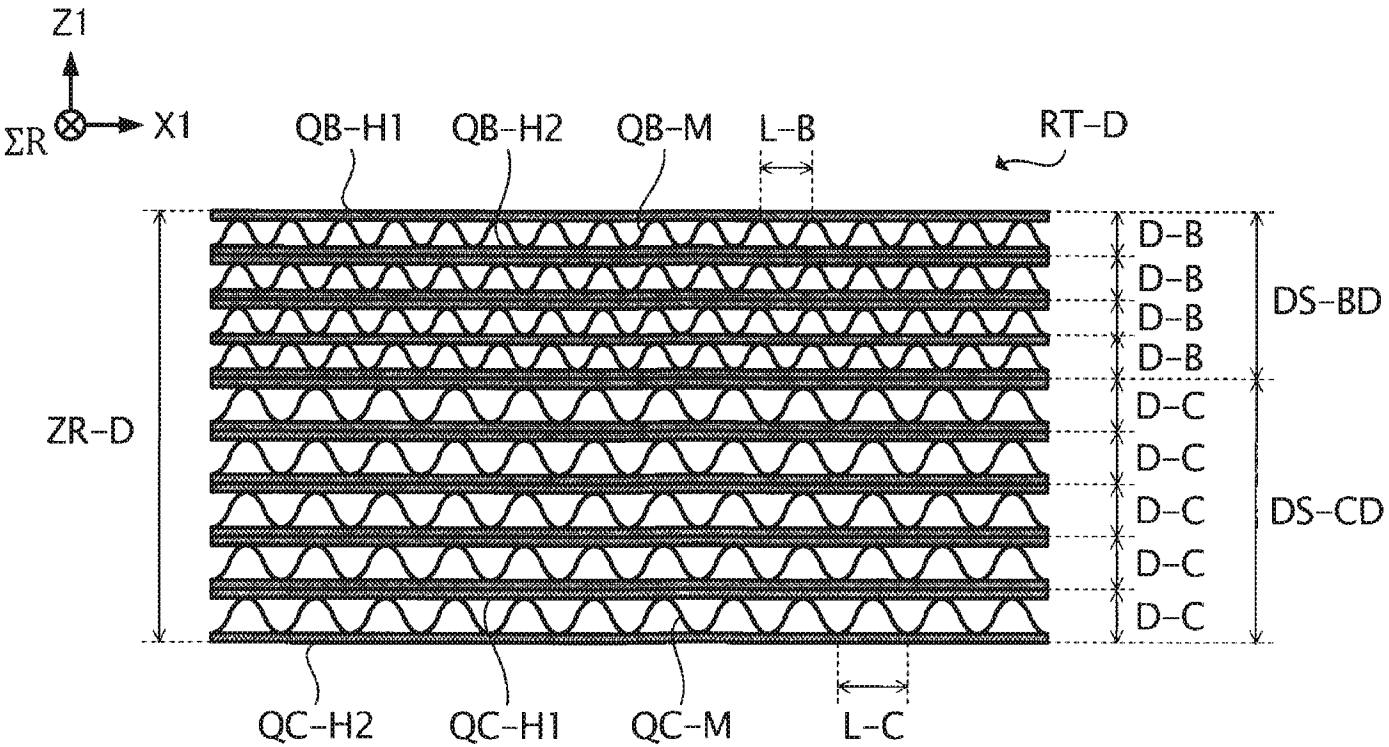
FIG. 10 is a cross-sectional view illustrating an example of a structure of a cushioning material of Comparative Example 3.

FIG. 10 is a cross-sectional view illustrating a cross-sectional configuration of a cushioning material RT-D of Comparative Example 3.

As illustrated in FIG. 10, the cushioning material RT-D includes a cushioning block DS-BD that includes the stacked cushioning sheets D-B and a cushioning block DS-CD that includes the stacked cushioning sheets D-C. In Comparative Example 3, the number of cushioning sheets D-C included in the cushioning block DS-CD is larger than the number of cushioning sheets D-B included in the cushioning block DS-BD. Specifically, in Comparative Example 3, the cushioning block DS-BD includes four cushioning sheets D-B, and the cushioning block DS-CD includes five cushioning sheets D-C.

In the following description, a thickness ZR-D is the thickness in the Z axis direction of the cushioning material RT-D. Furthermore, in the following description, a reference thickness ZR-DO is the thickness ZR-D in the Z axis direction of the cushioning material RT-D not compressed in the Z axis direction with no force in the Z axis direction acting on the cushioning material RT-D. Furthermore, in the following description, a compression coefficient VZ-D is a value obtained by dividing the compressed thickness, which is obtained by subtracting the thickness ZR-D from the reference thickness ZR-DO, by the reference thickness ZR-D0.

Figure 11:
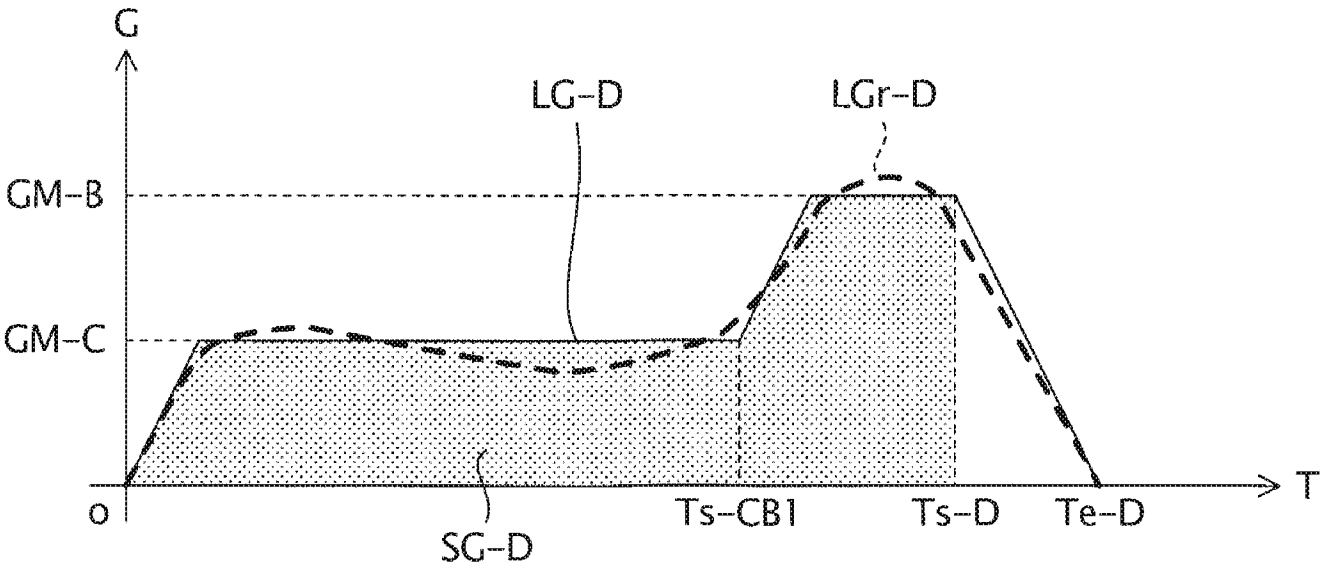
FIG. 11 is a diagram for explaining an example of the acceleration of the electrical device.

FIG. 11 is a diagram indicating an example of an external force acting on the electrical device 100 through the cushioning material RT-D.

Specifically, FIG. 11 indicates the acceleration G of the electrical device 100 in a case in which the packing material 1 holding the electrical device 100 having a predetermined weight is dropped on a floor from a predetermined height. More specifically, in FIG. 11, an acceleration line LG-D indicates a change over time in the acceleration G of the electrical device 100, which is held in the packing material 1, during its fall from a predetermined height with the cushioning material RT-D being present between the electrical device 100 and the floor.

As described above, when the electrical device 100 is dropped from a predetermined height with the cushioning material RT-D being present between the electrical device 100 and the floor, the cushioning sheets D-C, which have a low strength in the Z axis direction, are compressed and crushed flat before the cushioning sheets D-B. Thus, when the electrical device 100 is dropped from a predetermined height with the cushioning material RT-D being present between the electrical device 100 and the floor, the electrical device 100 receives the compressive force FM-C from the cushioning sheets D-C of the cushioning material RT-D first, and then receives the compressive force FM-B from the cushioning sheets D-B of the cushioning material RT-D after all the cushioning sheets D-C of the cushioning material RT-D are compressed and crushed flat. Thus, as indicated in FIG. 11, when the electrical device 100 is dropped from a predetermined height with the cushioning material RT-D being present between the electrical device 100 and the floor, the electrical device 100 has the acceleration GM-C corresponding to the compressive force FM-C first and then has the acceleration GM-B corresponding to the compressive force FM-B.

In FIG. 11, when the electrical device 100 is dropped from a predetermined height with the cushioning material RT-D being present between the electrical device 100 and the floor, the electrical device 100 is supposed to stop after all the cushioning sheets D-C of the cushioning material RT-D are compressed and crushed flat and before all the cushioning sheets D-B of the cushioning material RT-D are compressed and crushed flat. Specifically, in FIG. 11, when the electrical device 100 is dropped from a predetermined height with the cushioning material RT-D being present between the electrical device 100 and the floor, the cushioning material RT-D is supposed to absorb the drop impact of the electrical device 100 at the time Ts-D, which is after the time Ts-CB1 when all the cushioning sheets D-C of the cushioning material RT-D are compressed and crushed flat and before the time Ts-D when the cushioning sheets D-B of the cushioning material RT-D are compressed and crushed flat.

Here, an area SG-D defined by the acceleration line LG-D and the line indicating the acceleration G=0 in the period from the time T=0, at which the packing material 1 holding the electrical device 100 comes in contact with the floor, to the time Ts-D is equal to the above-described areas SG-B and SG-C. Thus, the time Ts-D is after the time Ts-B and before the time Ts-C.

The acceleration line LG-D does not indicate the actual measured values of the acceleration G of the electrical device 100 but indicates the logical values of the acceleration G of the electrical device 100. When the electrical device 100 held in the packing material 1 was dropped on a floor from a predetermined height, the actual measured values of the acceleration G of the electrical device 100 draw an acceleration line LGr-D in FIG. 11. As indicated in FIG. 11, the acceleration line LGr-D forms a waveform having two peaks. The acceleration line LGr-D is a curved line in which the acceleration G starts increasing from "0" at the time T=0 and returns to "0" at the time Te-D.

Figure 12:
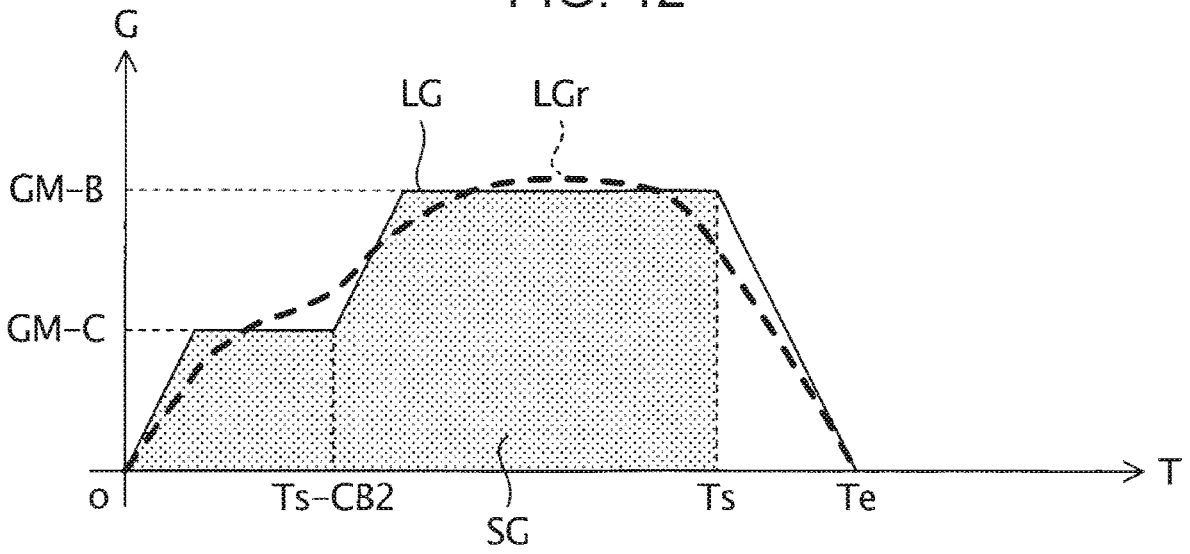
FIG. 12 is a diagram for explaining an example of the acceleration of the electrical device.

FIG. 12 is a diagram indicating an example of an external force acting on the electrical device 100 through the cushioning material R of this embodiment.

Specifically, FIG. 12 indicates the acceleration G of the electrical device 100 in a case in which the packing material 1 holding the electrical device 100 having a predetermined weight is dropped on a floor from a predetermined height. More specifically, in FIG. 12, an acceleration line LG indicates a change over time in the acceleration G of the electrical device 100, which is held in the packing material 1, during its fall from a predetermined height with the cushioning material R being present between the electrical device 100 and the floor.

When the electrical device 100 is dropped from a predetermined height with the cushioning material R being present between the electrical device 100 and the floor, the electrical device 100 receives the compressive force FM-C from the cushioning sheets D-C of the cushioning material R first, and then receives the compressive force FM-B from the cushioning sheets D-B of the cushioning material R after all the cushioning sheets D-C of the cushioning material R are compressed and crushed flat. Thus, as indicated in FIG. 12, when the electrical device 100 is dropped from a predetermined height with the cushioning material R being present between the electrical device 100 and the floor, the electrical device 100 has the acceleration GM-C corresponding to the compressive force FM-C first and then has the acceleration GM-B corresponding to the compressive force FM-B.

In FIG. 12, when the electrical device 100 is dropped from a predetermined height with the cushioning material R being present between the electrical device 100 and the floor, the electrical device 100 is supposed to stop after all the cushioning sheets D-C of the cushioning material R are compressed and crushed flat and before all the cushioning sheets D-B of the cushioning material R are compressed and crushed flat. Specifically, in FIG. 12, when the electrical device 100 is dropped from a predetermined height with the cushioning material R being present between the electrical device 100 and the floor, the cushioning material R is supposed to absorb the drop impact of the electrical device 100 at the time Ts, which is after the time Ts-CB2 when all the cushioning sheets D-C of the cushioning material R are compressed and crushed flat and before the time Ts when the cushioning sheets D-B of the cushioning material R are compressed and crushed flat.

Here, an area SG defined by the acceleration line LG and the line indicating the acceleration G=0 in the period from the time T=0, at which the packing material 1 holding the electrical device 100 comes contact with the floor, to the time Ts is equal to the above-described areas SG-B, SG-C, and SG-D. Furthermore, the time Ts-CB2 is before the time Ts-CB1. Thus, the time Ts is after the time Ts-B and before the time Ts-C and the time Ts-D.

The acceleration line LG does not indicate the actual measured values of the acceleration G of the electrical device 100 but indicates the logical values of the acceleration G of the electrical device 100. When the electrical device 100 held in the packing material 1 was dropped on a floor from a predetermined height, the actual measured values of the acceleration G of the electrical device 100 draw an acceleration line LGr in FIG. 12. As described above, the time Ts-CB2 is before the time Ts-CB1. As indicated in FIG. 12, the acceleration line LGr is a half-sine wave having one peak. The acceleration line LG is a curved line in which the acceleration G starts increasing from "0" at the time T=0 and returns to "0" at the time Te. A half-sine wave may be described as a half-sine shock pulse.

Figure 13:
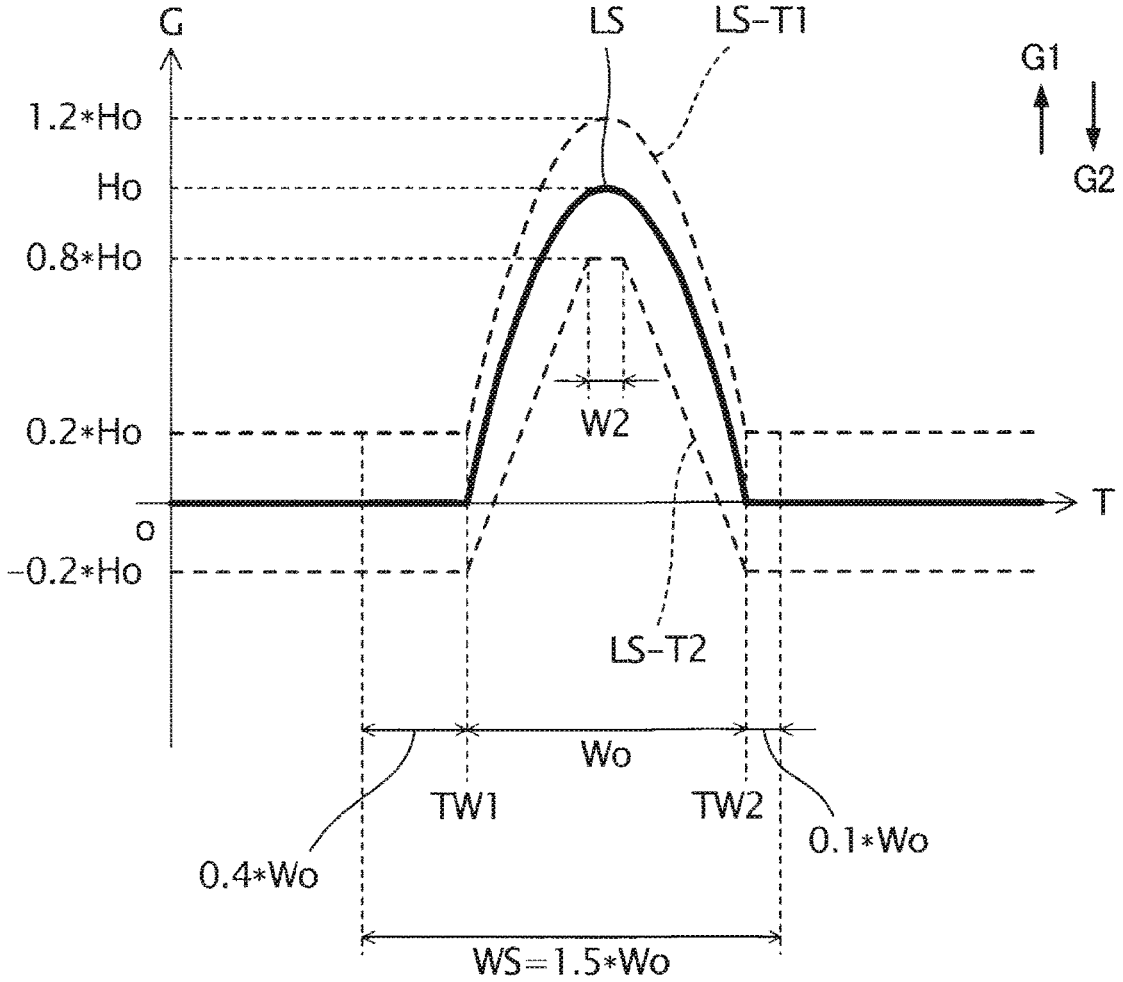
FIG. 13 is a diagram for explaining a half-sine wave.

FIG. 13 is a diagram for explaining a half-sine wave. In FIG. 13, the horizontal line indicates the time T, and the vertical line indicates the acceleration G, for explanation of the half-sine wave. In FIG. 13, a G1 direction is a direction in which the acceleration G increases, and a G2 direction is a direction in which the acceleration G decreases.

As indicated in FIG. 13, the half-sine wave is a waveform located between an upper border line LS-T1, which is away from an ideal waveform LS in the G1 direction, and a lower border line LS-T2, which is away from the ideal waveform LS in the G2 direction.

Here, the ideal waveform LS has the acceleration G of "0" at the start of observation of the half-sine wave and the maximum acceleration G of "Ho" in the observation period WS of the half-sine wave and has a shape corresponding to a half period of the sine wave. The upper border line LS-T1 is a waveform corresponding to the ideal waveform LS slid in the G1 direction by "0.2*Ho". In other words, the upper border line LS-T1 is a waveform that has the acceleration G of "0.2*Ho" at the start of the observation of the half-sine wave and has the maximum acceleration G of "1.2*Ho" in the observation period WS of the half-sine wave. Furthermore, the lower border line LS-T2 is a waveform that has the acceleration G of "−0.2*Ho" at the start of observation of the half-sine wave and the maximum acceleration G of "0.8*Ho" in the observation period WS of the half-sine wave. The period W2 in which the lower border line LS-T2 has the acceleration G of "0.8*Ho" only needs to be longer than "0", for example. Furthermore, the observation period WS of the half-sine wave is 1.5 times as long as the period Wo corresponding to a half period of the sine wave of the ideal waveform LS. Specifically, the observation period WS starts "0.4*Wo" before the acceleration G of the ideal waveform LS starts increasing from "$_0$" and ends "0.1*Wo" after the acceleration G of the ideal waveform LS returns to "0". In the following description, as indicated in FIG. 13, the time TW1 is the start of the period Wo, which corresponds to the half period of the sine wave of the ideal waveform LS, and the time TW2 is the end of the period Wo.

In this embodiment, for example, when the ideal waveform LS, the upper border line LS-T1, and the lower border line LS-T2 in FIG. 13 are superimposed on the acceleration line LGr in FIG. 12 such that the time TW1 in FIG. 13 becomes the time T=0 in FIG. 12, the time TW2 in FIG. 13 becomes the time Te in FIG. 12, and the value Ho in FIG. 13 becomes the maximum value in the acceleration line LGr in FIG. 12, the acceleration line LGr is located between the upper border line LS-T1 and the lower border line LS-T2. In this embodiment, the acceleration line LGr in FIG. 12 corresponds to the half-sine wave. For example, when the ideal waveform LS, the upper border line LS-T1, and the lower border line LS-T2 in FIG. 13 are superimposed on the acceleration line LGr-B in FIG. 9 such that the time TW1 in FIG. 13 becomes the time T=0 in FIG. 9, the time TW2 in FIG. 13 becomes the time Te-B in FIG. 9, and the value Ho in FIG. 13 becomes the maximum value in the acceleration line LGr-B in FIG. 9, the acceleration line LGr-B has a portion located outside the region between the upper border line LS-T1 and the lower border line LS-T2. In Comparative Example 1, the acceleration line LGr-B in FIG. 9 does not correspond to the half-sine wave. Furthermore, for example, when the ideal waveform LS, the upper border line LS-T1, and the lower border line LS-T2 in FIG. 13 are superimposed on the acceleration line LGr-C in FIG. 9 such that the time TW1 in FIG. 13 becomes the time T=0 in FIG. 9, the time TW2 in FIG. 13 becomes the time Te-C in FIG. 9, and the value Ho in FIG. 13 becomes the maximum value in the acceleration line LGr-C in FIG. 9, the acceleration line LGr-C has a portion located outside the region between the upper border line LS-T1 and the lower border line LS-T2. In Comparative Example 2, the acceleration line LGr-C in FIG. 9 does not correspond to the half-sine wave. Furthermore, for example, when the ideal waveform LS, the upper border line LS-T1, and the lower border line LS-T2 in FIG. 13 are superimposed on the acceleration line LGr-D in FIG. 11 such that the time TW1 in FIG. 13 becomes the time T=0 in FIG. 11, the time TW2 in FIG. 13 becomes the time Te-D in FIG. 11, and the value Ho in FIG. 13 becomes the maximum value in the acceleration line LGr-D in FIG. 11, the acceleration line LGr-D has a portion located outside the region between the upper border line LS-T1 and the lower border line LS-T2. In Comparative Example 3, the acceleration line LGr-D in FIG. 11 does not correspond to the half-sine wave.

The frequency bandwidth of a trapezoidal waveform expressed by superimposed sine waves is typically broader than the frequency bandwidth of a half-sine wave expressed by superimposed sine waves. Furthermore, the frequency bandwidth of a waveform having two peaks expressed by superimposed sine waves is broader than the frequency bandwidth of a half-sine wave expressed by superimposed sine waves. Typically, the frequency bandwidth of a waveform other than the half-sine wave expressed by superimposed sine waves is broader than the frequency bandwidth of a half-sine wave expressed by superimposed sine waves. In other words, the frequency bandwidth of the acceleration line LGr-B of Comparative Example 1 expressed by the superimposed sine waves, the frequency bandwidth of the acceleration line LGr-C of Comparative Example 2 expressed by the superimposed sine waves, and the frequency bandwidth of the acceleration line LGr-D of Comparative Example 3 expressed by the superimposed sine waves are broader than the frequency bandwidth of the acceleration line LGr of the present embodiment expressed by the superimposed sine waves. Thus, the acceleration line LGr-B is more likely to have a natural frequency of the electrical device 100 than the acceleration line LGr, the acceleration line LGr-C is more likely to have a natural frequency of the electrical device 100 than the acceleration line LGr, and the acceleration line LGr-D is more likely to have a natural frequency of the electrical device 100 than the acceleration line LGr. More specifically, the components of the electrical device 100 have different natural frequencies. When the natural frequencies of the components of the electrical device 100 are equal to the frequencies included in the impact waveform, a resonance-like phenomenon occurs. This may damage the components of the electrical device 100. To solve this problem, this disclosure has the acceleration line LGr having a half-sine wave and thus is less likely to have the natural frequencies of the components of the electrical device 100 in the acceleration line LGr than Comparative Examples 1 to 3. Here, the "resonance-like phenomenon" involves conception of not only an increase in amplitude of oscillation having more than one period, such as repeated sine wave oscillation, but also an increase in amplitude of oscillation having less than one period such as a half-sine wave oscillation. In this specification, the "resonance-like phenomenon" may be simply referred to as "resonance".

In Comparative Example 1, the acceleration line LGr-B may have the natural frequency of the electrical device 100. In such a case, when the cushioning material RT-B reduces the external force acting on the falling electrical device 100, resonance may occur in a system including the electrical device 100 and the cushioning material RT-B due to the cushioning material RT-B located between the electrical device 100 and the floor. This may cause the electrical device 100 to oscillate at an amplitude larger than the maximum value of the acceleration G indicated by the acceleration line LGr-B. Similarly in Comparative Example 2, due to the cushioning material RT-C located between the electrical device 100 and the floor, when the cushioning material RT-C reduces the external force acting on the falling electrical device 100, the electrical device 100 may oscillate at an amplitude larger than the maximum value of the acceleration G indicated by the acceleration line LGr-C. Similarly in Comparative Example 3, due to the cushioning material RT-D located between the electrical device 100 and the floor, when the cushioning material RT-D reduces the external force acting on the falling electrical device 100, the electrical device 100 may oscillate at an amplitude larger than the maximum value of the acceleration G indicated by the acceleration line LGr-D. As in Comparative Examples 1 to 3, when the electrical device 100 oscillates largely due to the resonance, the oscillation may damage the electrical device 100. In contrast, the acceleration line LGr of the present embodiment is less likely to have the natural frequency of the electrical device 100 than those of Comparative Examples 1 to 3. Thus, the cushioning material R of this embodiment is less likely to have resonance in a system including the electrical device 100 than that of Comparative Examples 1 to 3. Thus, this embodiment can reduce the possibility that the electrical device 100 will be damaged by the external force acting on the electrical device 100 through the cushioning material R compared with Comparative Examples 1 to 3.

Furthermore, Comparative Examples 1 to 3 need to have extra cushioning sheets D to make the cushioning material to be enough thick to reduce the external force acting on the electrical device 100 even when the electrical device 100 and the packing material 1 are subjected to resonance. In contrast, the present embodiment can determine the number of cushioning sheets D without consideration of resonance in the electrical device 100 and the packing material 1. In other words, this embodiment can protect the electrical device 100 from the external force even when having fewer cushioning sheets D than Comparative Examples 1 to 3. The present embodiment can more readily achieve both the reduction in the number of cushioning sheets D and protection of the electrical device 100 from the external force than Comparative Examples 1 to 3. As in Comparative Examples 1 to 3, when the packing material 1 is designed in consideration of the influence of resonance, the cushioning sheet D having a low strength may be designed, for example. To reduce the acceleration applied to the electrical device 100 under influence of resonance, the cushioning material may include a sufficient number of stacked cushioning sheets D not to be crushed flat during a period from when the electrical device 100 starts falling and to when the electrical device 100 stops. However, in such a case, the number of cushioning sheets D of the cushioning material becomes too large, and the cushioning material becomes too big. This increases the size of the packing material 1, leading to an increase in the cost of the cushioning material and also an increase in the transportation cost, because this limits the number of packages to be transported in one time. In contrast, the present embodiment achieves both the reduction in number of cushioning sheets D of the cushioning material R and protection of the electrical device 100 from the external force and solves the problems of increase in the cost of the cushioning material and increase in the cost of transportation.

4. Test Results

Next, with reference to FIG. 14, results of a drop test of the electrical device 100 will be described.

Figure 14:
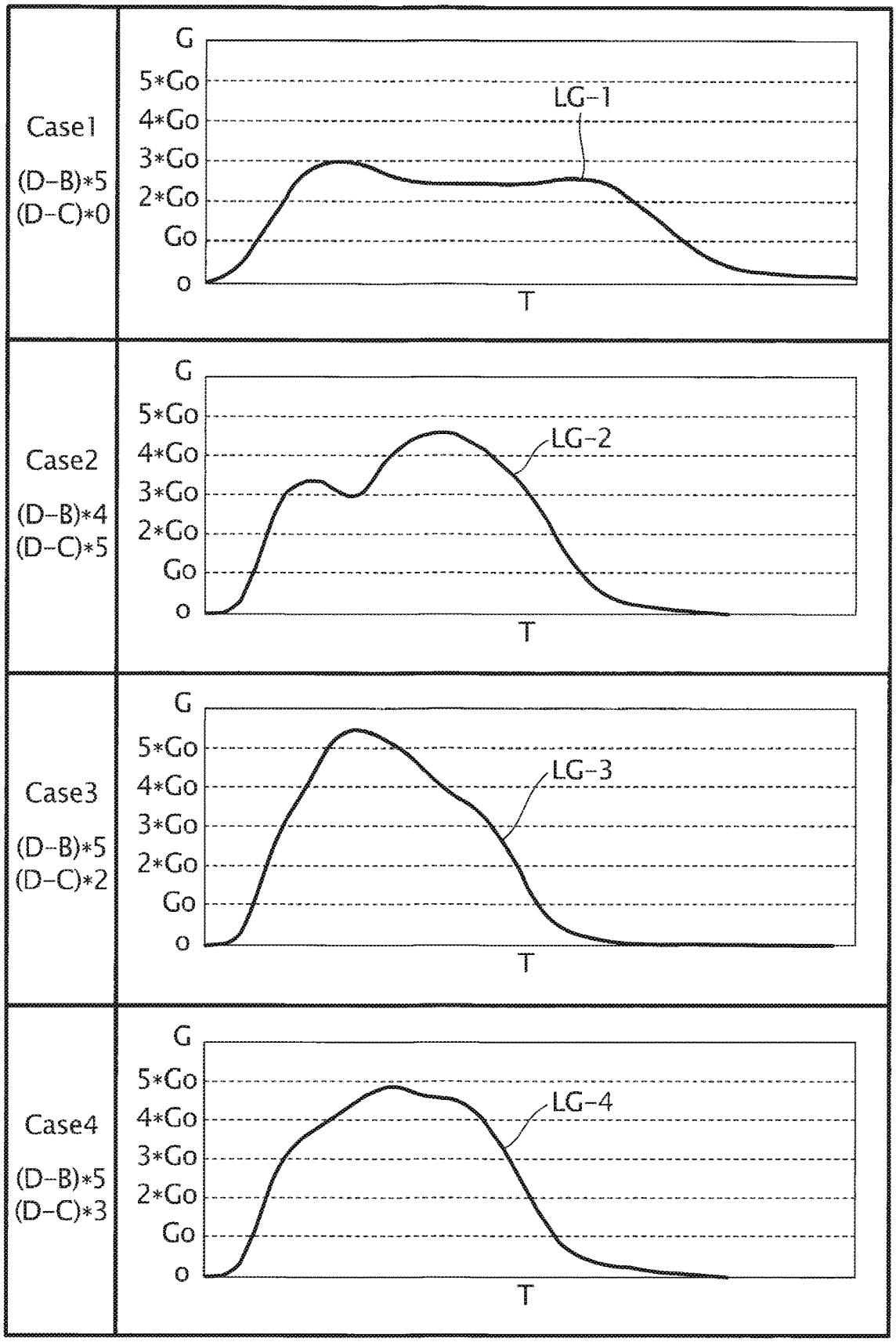
FIG. 14 is a diagram for explaining results of a drop test of the electrical device.

FIG. 14 includes diagrams indicating actual measured values of the acceleration G of the electrical device 100 in a case in which the packing material 1 holding the electrical device 100 was dropped on a floor from a predetermined height. In FIG. 14, the value Go is a predetermined value.

Of the diagrams, Case 1 is a diagram indicating an acceleration line LG-1 having the actual measured values of the acceleration G of the electrical device 100 that was dropped from a predetermined height with the cushioning material RT-1 being present between the electrical device 100 and a floor. The cushioning material RT-1 includes five cushioning sheets D-B and does not include the cushioning sheet D-C. As indicated in FIG. 14, the acceleration line LG-1 indicates a trapezoidal wave having two peaks. Thus, when the electrical device 100 is held in the packing material 1 having the cushioning material RT-1, resonance occurs in a system including the electrical device 100 and the cushioning material RT-1 upon application of an external force to the electrical device 100, and thus the electrical device 100 is likely to oscillate at an amplitude higher than the maximum of the acceleration G of the acceleration line LG-1.

Case 2 is a diagram indicating an acceleration line LG-2 having the actual measured values of the acceleration G of the electrical device 100 that was dropped from a predetermined height with the cushioning material RT-2 being present between the electrical device 100 and a floor. The cushioning material RT-2 includes four cushioning sheets D-B and five cushioning sheets D-C. As indicated in FIG. 14, the acceleration line LG-2 indicates a waveform having two peaks. Thus, when the electrical device 100 is held in the packing material 1 having the cushioning material RT-2, resonance occurs in a system including the electrical device 100 and the cushioning material RT-2 upon application of an external force to the electrical device 100, and thus the electrical device 100 is likely to oscillate at an amplitude higher than the maximum of the acceleration G of the acceleration line LG-2.

Case 3 is a diagram indicating an acceleration line LG-3 having the actual measured values of the acceleration G of the electrical device 100 that was dropped from a predetermined height with the cushioning material RT-3 being present between the electrical device 100 and a floor. The cushioning material RT-3 includes five cushioning sheets D-B and two cushioning sheets D-C. As indicated in FIG. 14, the acceleration line LG-3 indicates a half-sine wave having one peak. Thus, when the electrical device 100 is held in the packing material 1 having the cushioning material RT-3, resonance is less likely to occur in a system including the electrical device 100 and the cushioning material RT-3 upon application of an external force to the electrical device 100.

Case 4 is a diagram indicating an acceleration line LG-4 having the actual measured values of the acceleration G of the electrical device 100 that was dropped from a predetermined height with the cushioning material RT-4 being present between the electrical device 100 and a floor. The cushioning material RT-4 includes five cushioning sheets D-B and three cushioning sheets D-C as the cushioning material R of the present embodiment. As indicated in FIG. 14, the acceleration line LG-4 indicates a half-sine wave having one peak. Thus, when the electrical device 100 is held in the packing material 1 having the cushioning material RT-4, resonance is less likely to occur in a system including the electrical device 100 and the cushioning material RT-4 upon application of an external force to the electrical device 100.

As described above, the configurations such as the cushioning materials RT-3 and RT-4, in which the number of cushioning sheets D-B is larger than the number of cushioning sheets D-C, is less likely to have resonance in a system including the electrical device 100 and the packing material 1 than the configurations such as the cushioning material RT-1, which includes only the cushioning sheets D-B, and the cushioning material RT-2, in which the number of cushioning sheets D-B is smaller than the cushioning sheets D-C. In other words, as in the present embodiment, the cushioning material R in which the number of cushioning sheets D-B is larger than the number of cushioning sheets D-C can further reduce the possibility that the electrical device 100 will be damaged by the external force acting on the electrical device 100 through the cushioning material R compared with a cushioning material including fewer cushioning sheets D-B than the cushioning sheets D-C.

In this embodiment, the number of cushioning sheets D-B included in the cushioning material R is larger than the number of cushioning sheets D-C included in the cushioning material R. However, the present disclosure should not be limited to this. The number of cushioning sheets D-B included in the cushioning material R may be equal to the number of cushioning sheets D-C included in the cushioning material R. Furthermore, in this embodiment, the cushioning material R includes multiple cushioning sheets D-C. However, the present disclosure should not be limited to this. The number of cushioning sheet D-C included in the cushioning material R may be one or two or more. Furthermore, in this embodiment, when the cushioning material R is viewed in plan view in the Z axis direction perpendicular to the cushioning sheet D, the cushioning sheets D of the cushioning material R may have substantially the same size. Here, "substantially the same" involves conception of a situation being completely the same and a situation being apparently the same within tolerance. The "tolerance" may be 10% or less difference, for example.

5. Conclusion of Embodiment

As described above, the cushioning material R according to the present embodiment includes the cushioning sheets D stacked on top of another and configured to reduce an external force acting on the electrical device 100. The cushioning sheets D include the cushioning sheet D-C that is positioned to intersect the Z axis direction and the cushioning sheet D-B that has a higher strength in the Z axis direction than the cushioning sheet D-C and is positioned to intersect the Z axis direction.

In the present embodiment, the cushioning material R first reduces the external force acting on the electrical device 100 with the cushioning sheet D-C and allows transmission of the compressive force FM-C to the electrical device 100 such that the electrical device 100 has the acceleration GM-C and then reduces the external force acting on the electrical device 100 with the cushioning sheet D-B and allows transmission of the compressive force FM-B to the electrical device 100 such that the electrical device 100 has the acceleration GM-B. This embodiment can gradually increase the force transmitted to the electrical device 100, for example. This embodiment is more likely to allow the shape of the force transmitted to the electrical device 100 to be a half-sine wave than a configuration that includes the cushioning material R including only the cushioning sheets D-B or only the cushioning sheets D-C and thus can make the frequency bandwidth of the force transmitted to the electrical device 100 narrow. With this configuration, the present embodiment is less likely to allow resonance to occur in the system including the electrical device 100 and the cushioning material R than a configuration that includes the cushioning material R including only the cushioning sheets D-B or only the cushioning sheets D-C and thus can reduce damage of the electrical device 100.

In this embodiment, the cushioning sheet D-C is an example of the "first cushioning sheet", the cushioning sheet D-B is an example of the "second cushioning sheet", and the Z axis direction is an example of the "direction of the external force acting on the electrical device".

In the cushioning material R according to the present embodiment, the cushioning sheet D includes one or more cushioning sheets D-C, and the cushioning sheet D-B includes two or more cushioning sheets D-B that outnumber the cushioning sheets D-C.

In the present embodiment, this enables the shape of the force transmitted to the electrical device 100 to be a half-sine wave. In other words, this embodiment is less likely to allow resonance to occur in the system including the electrical device 100 and the cushioning material R than the configuration in which the number of cushioning sheets D-B is smaller than the number of cushioning sheets D-C and thus can reduce damage of the electrical device 100.

In the cushioning material R according to the present disclosure, the cushioning sheet D-C includes the liner QC-H1 having a plate-like shape and the core member QC-M attached to the liner QC-H1 and having a wave shape, and the cushioning sheet D-B includes the liner QB-H1 having a plate-like shape and the core member QC-M attached to the liner QB-H1 and having more curves than the core member QB-M per a reference length.

With this configuration, this embodiment can reduce an external force acting on the electrical device 100 with the core member QC-M and the core member QB-M. Furthermore, this embodiment enables the strength in the Z-axis direction of the cushioning sheet D-B to be higher than that of the cushioning sheet D-C and thus enables the shape of the force transmitted to the electrical device 100 to be a half-sine wave.

In this embodiment, the liner QC-H1 is an example of the "first plate-like portion", the liner QB-H1 is an example of the "second plate-like portion", the core member QC-M is an example of the "first wave-shape portion", and the core member QB-M is an example of the "second wave-shape portion".

In the cushioning material R according to the present embodiment, the cushioning sheet D-C includes the liner QC-H1 having a plate-like shape and the core member QC-M attached to the liner QC-H1 and having a wave shape. The cushioning sheet D-B includes the liner QB-H1 having a plate-like shape and the core member QB-M attached to the liner QB-H1 and having a wave shape lower in the Z axis direction than that of the core member QC-M.

With this configuration, this embodiment can reduce the external force acting on the electrical device 100 with the core member QC-M and the core member QB-M. Furthermore, this embodiment allows the strength in the Z-axis direction of the cushioning sheet D-B to be higher than that of the cushioning sheet D-C and thus enables the shape of the force transmitted to the electrical device 100 to be a half-sine wave.

In the cushioning material R of the present embodiment, the cushioning sheet D-B is to be located between the electrical device 100 and the cushioning sheet D-C.

With this configuration, in this embodiment, even if the cushioning sheet D-C having a low strength is compressed and crushed flat first, the cushioning sheet D-B adjacent to the electrical device 100 can reduce the external force acting on the electrical device 100.

In this embodiment, in a graph having a vertical axis indicating an external force acting on the electrical device 100 through the cushioning material R and a horizontal axis indicating time elapsed from when the external force starts acting on the electrical device 100 through the cushioning material R, a waveform indicating the external force acting on the electrical device 100 through the cushioning material R is a half-sine wave.

With this configuration, the present embodiment is less likely to allow resonance to occur in the system including the electrical device 100 and the cushioning material R than a configuration that includes the cushioning material R including only the cushioning sheets D-B or only the cushioning sheets D-C and thus can reduce damage of the electrical device 100.

B. Modifications

The above-described configurations may be modified in various ways. Examples of specific modified configurations are described below. Two or more configurations arbitrarily selected from the examples below may be combined as appropriate unless the configurations are inconsistent with each other. In the modifications described below, the same reference numeral is assigned to the component having substantially the same operation and function as that described above, and the component will not be explained in detail.

First Modification

In the above-described embodiment, the cushioning sheets D of the cushioning material R have substantially the same size when the cushioning material R is viewed in plan view in the Z axis direction, which is a direction perpendicular to the cushioning sheet D, but the present disclosure should not be limited to this. The cushioning sheets D of the cushioning material R may include two cushioning sheets D having different sizes when the cushioning material R is viewed in plan view in the Z axis direction.

Figure 15:
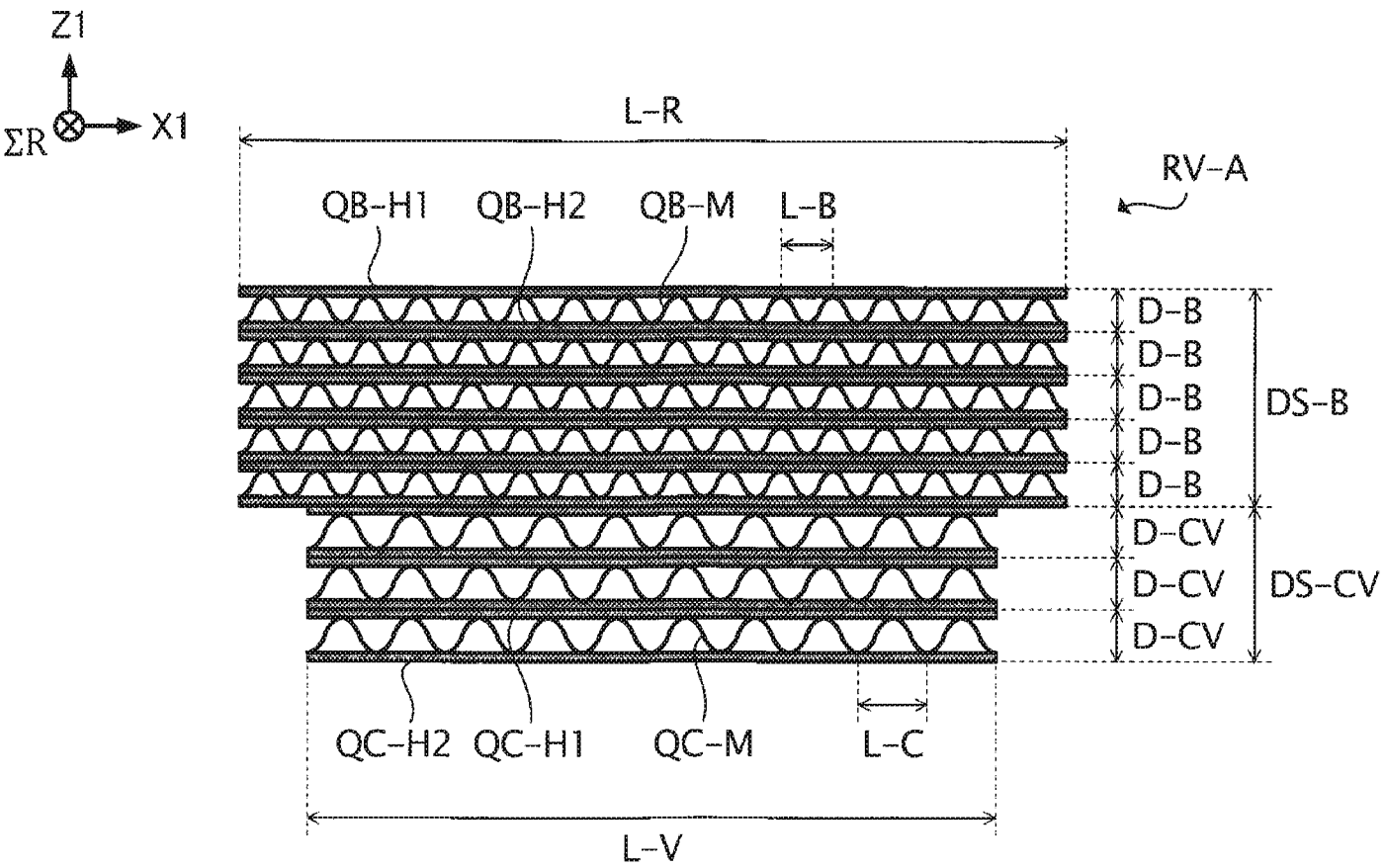
FIG. 15 is a cross-sectional view illustrating an example of a structure of a cushioning material according to a first modification.

FIG. 15 is a cross-sectional view illustrating a cross-sectional configuration of a cushioning material RV-A according to a first mode of First Modification.

As illustrated in FIG. 15, the cushioning material RV-A includes a cushioning block DS-B including stacked cushioning sheets D-B and a cushioning block DS-CV including stacked cushioning sheets D-CV. Specifically, in the cushioning material RV-A of this modification, the number of cushioning sheets D-B included in the cushioning block DS-B is larger than the number of cushioning sheets D-CV included in the cushioning block DS-CV. More specifically, the cushioning material RV-A of this modification, for example, includes the cushioning block DS-B that includes five cushioning sheets D-B and the cushioning block DS-CV that includes three cushioning sheets D-CV. In the cushioning material RV-A of this modification, the cushioning sheets D-B and the cushioning sheets D-CV are positioned to extend in a direction intersecting the Z axis direction. The cushioning material RV-A of this modification is to be positioned in the packing box 2 such that the cushioning block DS-B is located between the electrical device 100 and the cushioning block DS-CV.

As described above, the cushioning sheet D-B includes the liner QB-H1, the liner QB-H2, and the core member QB-M. The cushioning sheet D-CV includes the liner QC-H1, the liner QC-H2, and the core member QC-M as the cushioning sheet D-C. In this modification, the strength in the Z axis direction per unit area of the cushioning sheet D-B is higher than that of the cushioning sheet D-CV.

Furthermore, in this modification, when the cushioning material RV-A is viewed in plan view in the Z axis direction, the area of the cushioning sheet D-B is larger than that of the cushioning sheet D-CV. For example, in this modification, as illustrated in FIG. 15, the length L-R in the X axis direction of the cushioning sheet D-B is larger than the length L-V in the X axis direction of cushioning sheet D-CV. Thus, in this modification, the strength in the Z axis direction of the cushioning sheet D-B is larger than that of the cushioning sheet D-CV.

As described above, the cushioning material RV-A of this modification includes the cushioning sheets D-CV and the cushioning sheets D-B having a higher strength than the cushioning sheets D-CV. Thus, the cushioning material RV-A of this modification enables the force transmitted from the cushioning material RV-A to the electrical device 100 to gradually increase when an external force acts on the electrical device 100 through the cushioning material RV-A. Thus, the cushioning material RV-A of this modification is more likely to allow the shape of the force transmitted to the electrical device 100 to be a half-sine wave than a cushioning material RV-A including only the cushioning sheet D-B and a cushioning material RV-A including only the cushioning sheet D-CV and can reduce the possibility that resonance will occur in the system including the electrical device 100 and the cushioning material RV-A.

Figure 16:
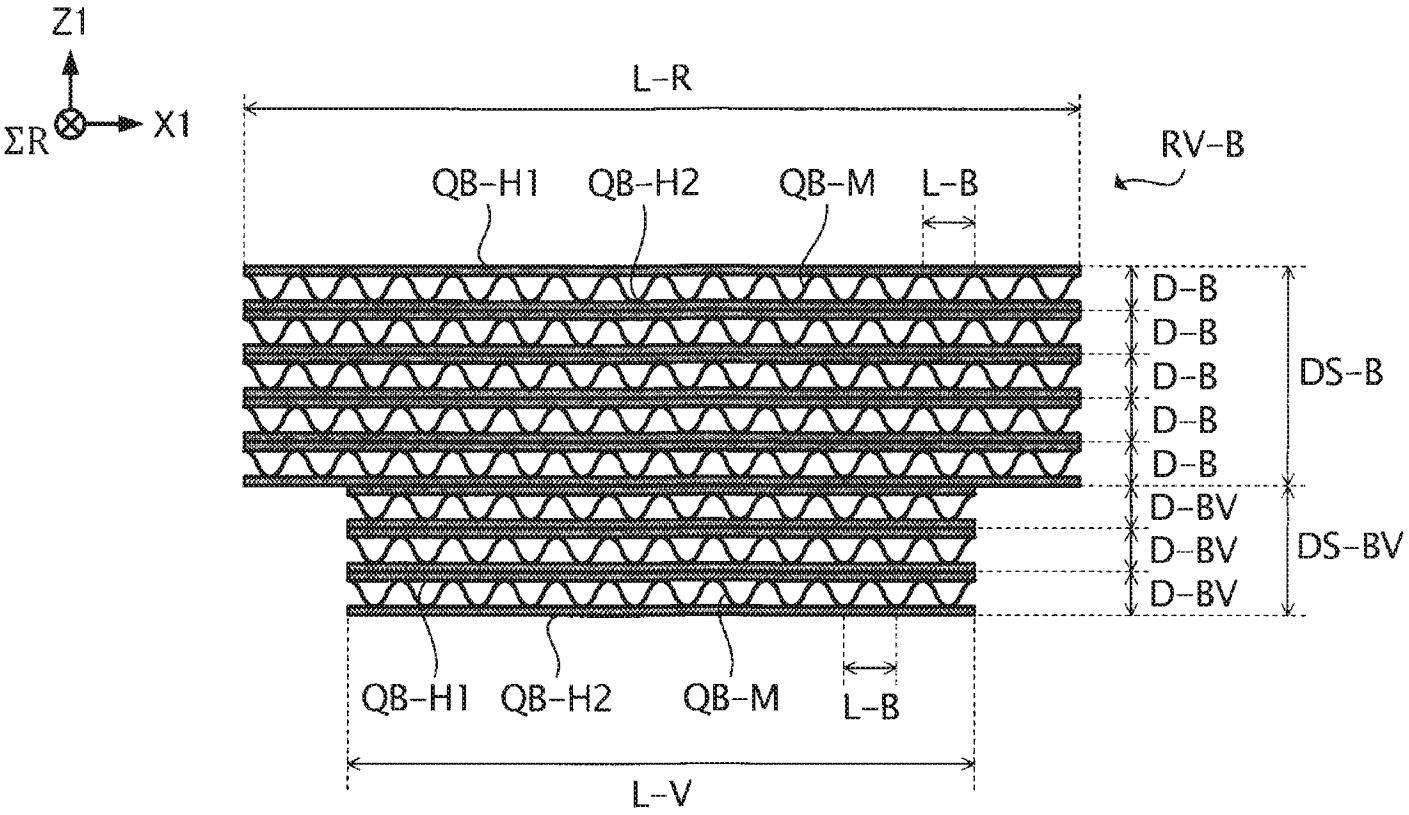
FIG. 16 is a cross-sectional view illustrating an example of a structure of a cushioning material according to the first modification.

FIG. 16 is a cross-sectional view illustrating a cross-sectional configuration of a cushioning material RV-B according to a second mode of First Modification.

As illustrated in FIG. 16, the cushioning material RV-B includes a cushioning block DS-B including stacked cushioning sheets D-B and a cushioning block DS-BV including stacked cushioning sheets D-BV. Specifically, in the cushioning material RV-B of this modification, the number of cushioning sheets D-B included in the cushioning block DS-B is larger than the number of cushioning sheets D-BV included in the cushioning block DS-BV. More specifically, in an example of the cushioning material RV-B of this modification, the cushioning block DS-B includes five cushioning sheets D-B, and the cushioning block DS-BV includes three cushioning sheets D-BV. In the cushioning material RV-B of this modification, the cushioning sheets D-B and the cushioning sheets D-BV are positioned to extend in a direction intersecting the Z axis direction. The cushioning material RV-B of this modification is to be positioned in the packing box 2 such that the cushioning block DS-B is located between the electrical device 100 and the cushioning block DS-BV.

The cushioning sheet D-BV includes the liner QB-H1, the liner QB-H2, and the core member QB-M. In this modification, the strength in the Z axis direction per unit area of the cushioning sheet D-B is substantially the same as that of the cushioning sheet D-BV.

Furthermore, in this modification, when the cushioning material RV-B is viewed in plan view in the Z axis direction, the cushioning sheet D-B has a larger area than the cushioning sheet D-BV. For example, in this modification, as illustrated in FIG. 16, the length L-R in the X axis direction of the cushioning sheet D-B is larger than the length L-V in the X axis direction of the cushioning sheet D-BV. In this modification, the strength in the Z axis direction of the cushioning sheet D-B is larger than that of the cushioning sheet D-BV.

As described above, the cushioning material RV-B of this modification includes the cushioning sheet D-BV and the cushioning sheet D-B having a higher strength than the cushioning sheet D-BV. Thus, the cushioning material RV-B of this modification enables the force transmitted from the cushioning material RV-B to the electrical device 100 to gradually increase when an external force acts on the electrical device 100 through the cushioning material RV-B. With this configuration, the cushioning material RV-B of this modification is more likely to allow the shape of the force transmitted to the electrical device 100 to be a half-sine wave a cushioning material RV-B including only the cushioning sheets D-B or only the cushioning sheets D-BV and thus can reduce the possibility that resonance will occur in the system including the electrical device 100 and the cushioning material RV-B.

Figure 17:
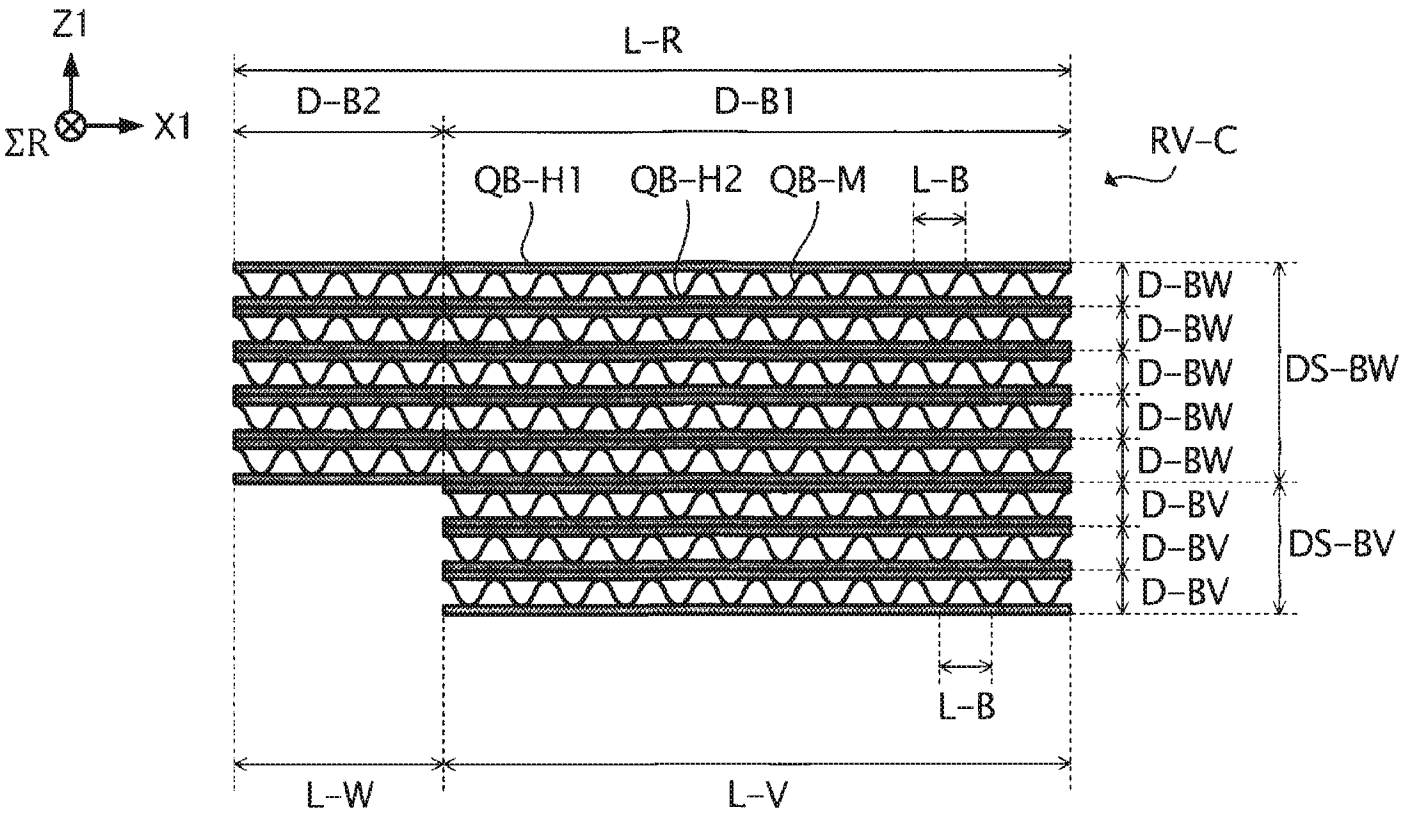
FIG. 17 is a cross-sectional view illustrating an example of a structure of a cushioning material according to the first modification.

FIG. 17 is a cross-sectional view illustrating a cross-sectional configuration of a cushioning material RV-C according to a third mode of First Modification.

As illustrated in FIG. 17, the cushioning material RV-C includes a cushioning block DS-BW including stacked cushioning sheets D-BW and a cushioning block DS-BV including stacked cushioning sheets D-BV. Specifically, in the cushioning material RV-C of this modification, the number of cushioning sheets D-BW included in the cushioning block DS-BW is larger than the number of cushioning sheets D-BV included in the cushioning block DS-BV. More specifically, in an example of the cushioning material RV-C of this modification, the cushioning block DS-BW includes five cushioning sheets D-BW, and the cushioning block DS-BV includes three cushioning sheets D-BV. In the cushioning material RV-C of this modification, the cushioning sheets D-BW and the cushioning sheets D-BV are positioned to extend in a direction intersecting the Z axis direction. The cushioning material RV-C of this modification is to be positioned in the packing box 2 such that the cushioning block DS-BW is located between the electrical device 100 and the cushioning block DS-BV.

The cushioning sheet D-BW includes a cushioning sheet D-B1 and a cushioning sheet D-B2, which are components in the same layer, at substantially the same position in the Z axis direction. Furthermore, the cushioning sheet D-BV includes the cushioning sheets D-B1. The cushioning sheet D-B1 and the cushioning sheet D-B2 each include the liner QB-H1, the liner QB-H2, and the core member QB-M. In this modification, the strength in the Z axis direction per unit area of the cushioning sheet D-BW is substantially the same as that of the cushioning sheet D-BV.

Furthermore, in this modification, when the cushioning material RV-C is viewed in plan view in the Z axis direction, the area of the cushioning sheet D-BW is larger than that of the cushioning sheet D-BV. Furthermore, in this modification, when the cushioning material RV-C is viewed in plan view in the Z axis direction, the area of the cushioning sheet D-B1 is larger than that of the cushioning sheet D-B2. For example, in this modification, as illustrated in FIG. 17, the length L-R in the X axis direction of the cushioning sheet D-BW is larger than the length L-V in the X axis direction of cushioning sheet D-BV. Furthermore, in this modification, as illustrated in FIG. 17, the length L-V in the X axis direction of the cushioning sheet D-B1 is larger than the length L-W in the X axis direction of cushioning sheet D-B2. Thus, in this modification, the strength in the Z axis direction of the cushioning sheet D-BW is larger than that of the cushioning sheet D-BV.

As described above, the cushioning material RV-C of this modification includes the cushioning sheet D-BV and the cushioning sheet D-BW having a higher strength than the cushioning sheet D-BV. Thus, the cushioning material RV-C of this modification enables the force transmitted from the cushioning material RV-C to the electrical device 100 to gradually increase when an external force acts on the electrical device 100 through the cushioning material RV-C. With this configuration, the cushioning material RV-C of this modification is more likely to allow the shape of the force transmitted to the electrical device 100 to be a half-sine wave than the configuration that includes the cushioning material RV-C including only the cushioning sheets D-BW or including only the cushioning sheets D-BV and thus can reduce the possibility that resonance will occur in the system including the electrical device 100 and the cushioning material RV-C.

As described above, when the cushioning material RV-A is viewed in plan view in the Z axis direction, the cushioning material RV-A of this modification has the cushioning sheet D-B having a larger area than the cushioning sheet D-CV.

This modification can gradually increase the force transmitted through the cushioning material RV-A to the electrical device 100. This modification is more likely to allow the shape of the force transmitted to the electrical device 100 to be a half-sine wave than the configuration that includes the cushioning material RV-A including only the cushioning sheets D-B or only the cushioning sheets D-CV. With this configuration, this modification is less likely to allow resonance to occur in the system including the electrical device 100 and the cushioning material RV-A than the configuration that includes the cushioning material RV-A including only the cushioning sheets D-B or only the cushioning sheets D-CV and thus can reduce damage of the electrical device 100.

As described above, the cushioning material RV-C according to the modification includes the cushioning sheets D stacked on top of another and configured to reduce an external force acting on the electrical device 100. The cushioning sheets D include the cushioning sheet D-BV that is positioned to intersect the Z axis direction and the cushioning sheet D-BW that has a higher strength in the Z axis direction than the cushioning sheet D-BV and is positioned to intersect the Z axis direction.

This embodiment can gradually increase the force transmitted through the cushioning material RV-C to the electrical device 100, for example. This modification is more likely to allow the shape of the force transmitted to the electrical device 100 to be a half-sine wave than the configuration that includes the cushioning material RV-C including only the cushioning sheets D-BW or only the cushioning sheets D-BV. With this configuration, this modification is less likely to allow resonance to occur in the system including the electrical device 100 and the cushioning material RV-C than the configuration that includes the cushioning material RV-C including only the cushioning sheets D-BW or only the cushioning sheets D-BV and thus can reduce damage of the electrical device 100.

In the modification, the cushioning sheet D is an example of the "cushioning structure", the cushioning sheet D-BV is an example of the "first cushioning structure", and the cushioning sheet D-BW is an example of the "second cushioning structure".

In the cushioning material RV-C according to the modification, the cushioning sheet D-BV includes the cushioning sheet D-B1 positioned to intersect the Z axis direction, the cushioning sheet D-BW includes the cushioning sheet D-B1 and the cushioning sheet D-B2 positioned in the same layer as the cushioning sheet D-B1 and positioned to intersect the Z axis direction, and when the cushioning material RV-C is viewed in plan view in the Z axis direction, the cushioning sheet D-B1 has a larger area than the cushioning sheet D-B2.

With this configuration, this modification can more effectively reduce an external force acting on the electrical device 100 than a configuration that includes a cushioning sheet D-B1 having a smaller area than the cushioning sheet D-B2.

In this modification, the cushioning sheet D-B1 is an example of the "first unit member", and the cushioning sheet D-B2 is an example of the "second unit member".

Second Modification

In the above-described embodiment and the first modification, the number of cushioning sheets D-B is larger than the number of cushioning sheets D-C in the cushioning material R, the number of cushioning sheets D-B is larger than the number of cushioning sheets D-CV in the cushioning material RV-A, the number of cushioning sheets D-B is larger than the cushioning sheets D-BV in the cushioning material RV-B, and the number of cushioning sheets D-BW is larger than the number of cushioning sheets D-BV in the cushioning material RV-C. However, the present disclosure should not be limited to this. For example, the type of cushioning sheets D constituting the cushioning material R may be determined such that the ratio of the number of cushioning sheets D-B to the number of cushioning sheets D constituting the cushioning material R becomes a predetermined ratio $\alpha$. Here, the value $\alpha$ preferably satisfies "$0.5 \leq \alpha < 1$", more preferably "$0.6 < \alpha < 0.8$".

Similarly, the type of cushioning sheet D constituting the cushioning material RV-A may be determined such that the ratio of the number of cushioning sheets D-B to the number of cushioning sheets D constituting the cushioning material RV-A becomes a predetermined ratio $\alpha$. The type of cushioning sheet D constituting the cushioning material RV-B may be determined such that the ratio of the number of cushioning sheets D-B to the number of cushioning sheets D constituting the cushioning material RV-B becomes a predetermined ratio α. The type of cushioning sheets D constituting the cushioning material RV-C may be determined such that the ratio of the number of cushioning sheets D-BW to the number of cushioning sheets D constituting the cushioning material RV-C becomes a predetermined ratio α.

Third Modification

Figure 18:
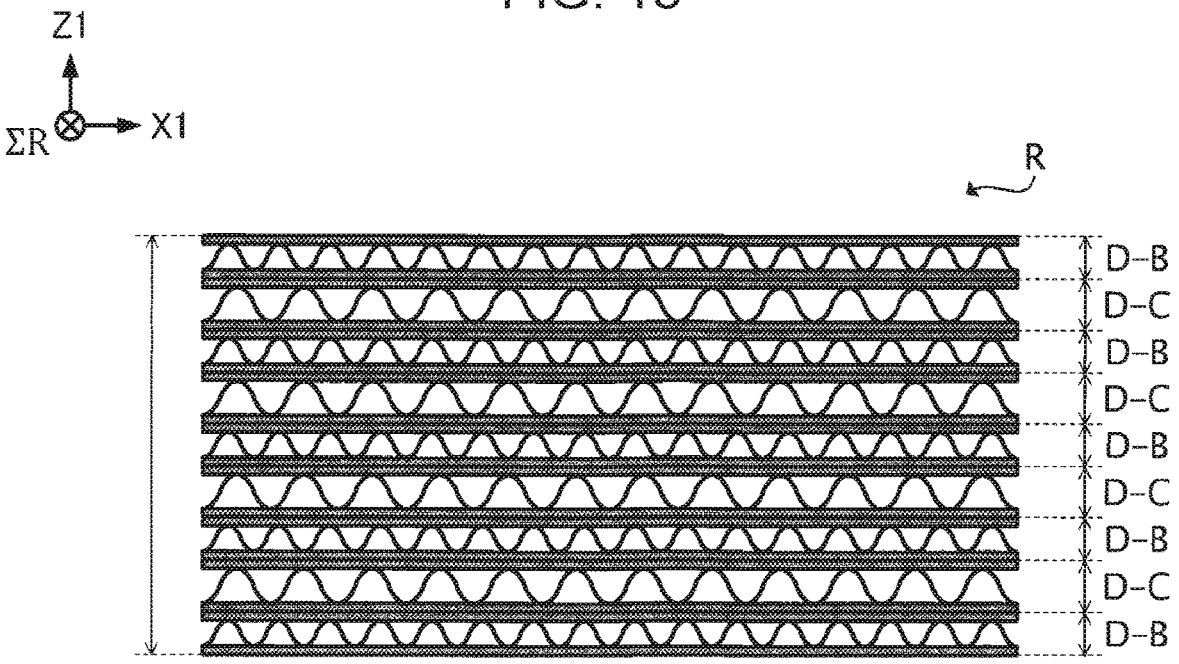
FIG. 18 is a cross-sectional view illustrating an example of a structure of a cushioning material according to a third modification.

In the above-described embodiment and the first and second modifications, the cushioning material R has the cushioning sheets D-B located between the cushioning sheets D-C and the electrical device 100, the cushioning material RV-A has the cushioning sheets D-B located between the cushioning sheets D-CV and the electrical device 100, the cushioning material RV-B has the cushioning sheets D-B located between the cushioning sheets D-BV and the electrical device 100, and the cushioning material RV-C has the cushioning sheets D-BW located between the cushioning sheets D-BV and the electrical device 100. However, the present disclosure should not be limited to this. For example, the cushioning material R may have the cushioning sheets D-C located between the cushioning sheets D-B and the electrical device 100, the cushioning material RV-A may have the cushioning sheets D-CV located between the cushioning sheets D-B and the electrical device 100, the cushioning material RV-B may have the cushioning sheets D-BV located between the cushioning sheets D-B and the electrical device 100, and the cushioning material RV-C may have the cushioning sheets D-BV located between the cushioning sheets D-BW and the electrical device 100. Furthermore, at least one or all of the cushioning sheets D-C may be located between the cushioning sheets D-B in the cushioning material R as illustrated in FIG. 18, at least one or all of the cushioning sheets D-CV may be located between the cushioning sheets D-B in the cushioning material RV-A, at least one or all of the cushioning sheets D-BV may be located between the cushioning sheets D-B in the cushioning material RV-B, and at least one or all of the cushioning sheets D-BV may be located between the cushioning sheets D-BW in the cushioning material RV-C.

Fourth Modification

Figure 19:
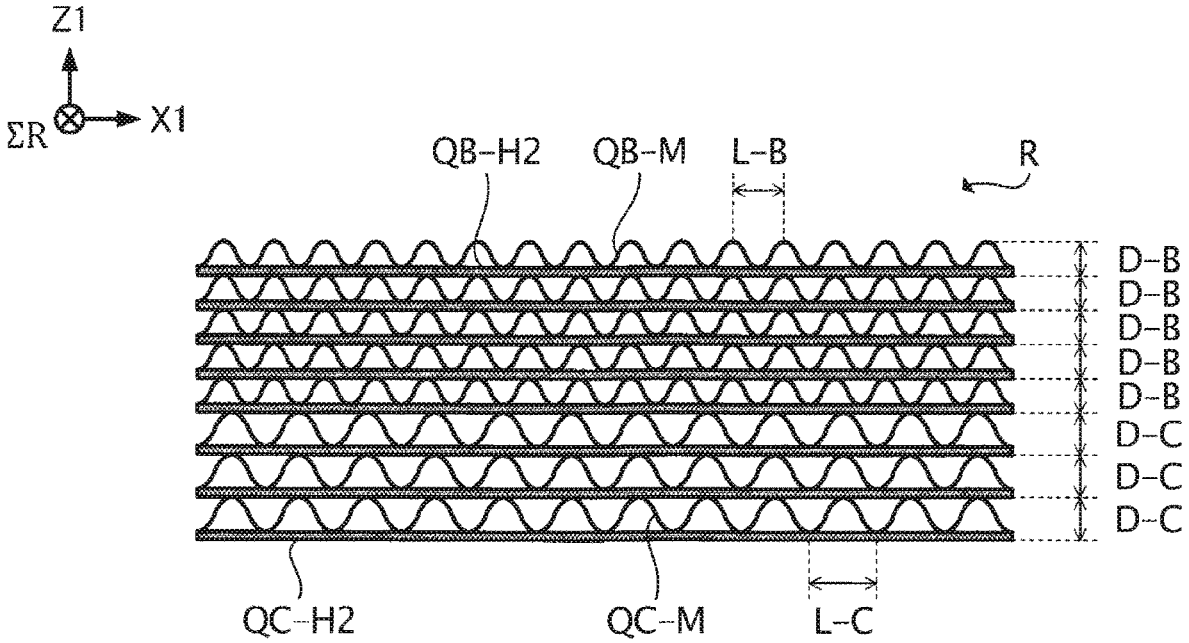
FIG. 19 is a cross-sectional view illustrating an example of a structure of a cushioning material according to a fourth modification.

In the above-described embodiment and the first to third modifications, the cushioning sheet D-B, which includes the liner QB-H1 and the liner QB-H2, and the cushioning sheet D-C, which includes the liner QC-H1 and the liner QC-H2, are described as examples. However, the present disclosure should not be limited to them. For example, as illustrated in FIG. 19, the cushioning sheet D-B only needs to include at least one of the liner QB-H1 and the liner QB-H2, and the cushioning sheet D-C only needs to include at least one of the liner QC-H1 and the liner QC-H2.

Fifth Modification

In the above-described embodiment and the first to fourth modifications, the cushioning sheet D formed of corrugated cardboard is described as examples. However, the present disclosure should not be limited to this. For example, the cushioning sheet D may be formed of a cushioning material other than corrugated cardboard, such as bubble cushioning material.

What is claimed is:

1. A cushioning material comprising cushioning sheets stacked on top of another and configured to reduce an external force acting on an electrical device that is to be placed on the cushioning material, wherein the cushioning sheets include a first cushioning sheet that is positioned to intersect a direction of the external force acting on the electrical device and a second cushioning sheet that has a higher strength in the direction of the external force acting on the electrical device than the first cushioning sheet and is positioned to intersect the direction of the external force acting on the electrical device, the first cushioning sheet includes a first plate-like portion having a plate-like shape and a first wave-shape portion attached to the first plate-like portion and having a wave shape, and the second cushioning sheet includes a second plate-like portion having a plate-like shape and a second wave-shape portion attached to the second plate-like portion and having more curves than the first wave-shape portion per a reference length.

2. The cushioning material according to claim 1, wherein the first cushioning sheet includes one or more first cushioning sheets, and the second cushioning sheet includes two or more second cushioning sheets that outnumber the first cushioning sheet(s).

3. The cushioning material according to claim 1, wherein the second cushioning sheet has a wave shape lower in the direction of the external force acting on the electrical device that is to be placed on the cushioning material than that of the first wave-shape portion.

4. The cushioning material according to claim 1, wherein the second cushioning sheet is to be located between the electrical device that is to be placed on the cushioning material and the first cushioning sheet.

5. The cushioning material according to claim 1, wherein, when the cushioning material is viewed in plan view in the direction of the external force acting on the electrical device that is to be placed on the cushioning material, the second cushioning sheet has a larger area than the first cushioning sheet.

6. The cushioning material according to claim 1, wherein, in a graph having a vertical axis indicating the external force acting on the electrical device and a horizontal axis indicating time elapsed from when the external force starts acting on the electrical device, a waveform indicating the external force acting on the electrical device is a half-sine shock pulse.

* * * * *